US005267778A

United States Patent [19]

Krebs et al.

[11] Patent Number: 5,267,778

[45] Date of Patent: Dec. 7, 1993

[54] POSITION CONTROL FOR A DENTAL CHAIR

[75] Inventors: Paul B. Krebs, Newberg; Bradley A. Rice, Salem; El Don L. Hoven, Newberg, all of Oreg.

[73] Assignee: A-Dec, Inc., Newberg, Oreg.

[21] Appl. No.: 939,945

[22] Filed: Sep. 2, 1992

Related U.S. Application Data

[62] Division of Ser. No. 501,674, Mar. 29, 1990, Pat. No. 5,190,349.

[51] Int. Cl.[5] ..... A47C 1/02

[52] U.S. Cl. ..... 297/330; 297/316

[58] Field of Search ..... 297/316, 361, 362, 330, 297/325

[56] References Cited

U.S. PATENT DOCUMENTS

| | | | |
|---|---|---|---|
| 2,672,917 | 3/1954 | Collura | 297/327 |
| 3,338,632 | 8/1967 | Kleinsorge . | |
| 3,414,324 | 7/1965 | Taylor et al. . | |
| 3,719,391 | 3/1973 | Neri | 297/330 X |
| 3,804,460 | 4/1974 | Leffler | 297/330 |
| 3,934,928 | 1/1976 | Johnson . | |
| 3,934,979 | 1/1976 | Rabinowitz | 297/330 X |
| 3,984,146 | 10/1976 | Krestel et al. . | |
| 4,128,797 | 12/1978 | Murata | 297/330 X |
| 4,173,372 | 11/1979 | Norris | 297/330 X |
| 4,264,849 | 4/1981 | Fleischer et al. . | |
| 4,367,894 | 1/1983 | Manuel . | |
| 4,527,976 | 7/1985 | Behringer et al. . | |
| 4,541,671 | 9/1985 | Broadhead et al. | 297/330 |
| 4,552,403 | 11/1985 | Yindra . | |
| 4,572,573 | 2/1986 | Yoshikawa et al. . | |
| 4,650,247 | 3/1907 | Berg et al. | 297/330 X |
| 4,655,505 | 4/1987 | Kashowamura et al. . | |
| 4,979,023 | 5/1990 | Rasmusson | 297/330 |
| 5,015,038 | 5/1991 | Stoeckl et al. | 297/330 X |

FOREIGN PATENT DOCUMENTS

| | | | |
|---|---|---|---|
| 2736276 | 11/1978 | Fed. Rep. of Germany | 297/330 |
| 2147728 | 6/1980 | Fed. Rep. of Germany | 297/330 |
| 2912758 | 10/1980 | Fed. Rep. of Germany | 297/330 |
| 2941105 | 12/1980 | Fed. Rep. of Germany | 297/330 |
| 3222832 | 12/1983 | Fed. Rep. of Germany | 297/330 |
| 3508515 | 9/1986 | Fed. Rep. of Germany | 297/330 |

*Primary Examiner*—Jose V. Chen
*Attorney, Agent, or Firm*—Klarquist Sparkman Campbell Leigh & Whinston

[57] ABSTRACT

The chair includes a movable seat and back that are configured to enhance the patient's comfort by providing lumbar support when the chair is in the recumbent position and by minimizing patient sliding within a moving chair. Chair movement is controlled by a microprocessor-based control system that includes sensing mechanisms for precisely monitoring the chair position. The sensing mechanisms are employed in conjunction with a memory device to permit the user to define a particular position into which the chair will move any time the appropriate switch is closed by the user. The chair control system diagnoses malfunctioning chair components and generates and displays data indicating the particular malfunctioning component.

15 Claims, 16 Drawing Sheets

POSITION CONTROL FOR A DENTAL CHAIR

This is a divisional of application Ser. No. 07/501,674, filed Mar. 29, 1990 now U.S. Pat. No. 5,190,349.

TECHNICAL FIELD

This invention pertains to dental chairs, and particularly to mechanisms for controlling the movement of the chair for enhancing the comfort of the patient and the convenience of the dentist.

BACKGROUND INFORMATION

Modern dental chairs include mechanisms for raising and lowering the chair seat and for tilting the back of the chair. A patient enters the chair while the chair is positioned with the back upright and with the seat elevated to a level that permits the patient to move comfortably from a standing to a sitting position. After the patient sits in the chair, the dentist or technician operates the chair to move the patient into the position selected by the dentist as appropriate for the dental procedure that is to be undertaken. For many procedures, the chair seat is raised and the back is tilted so that the patient assumes a recumbent position.

The patient's comfort is an important design consideration with respect to dental chairs. In this regard, the chair should be configured so that the patient is comfortable irrespective of the chair position. Moreover, the motion of the chair components should be directed to minimize sliding of the patient within the chair as the chair is moved from one position to another.

Another important dental chair design consideration may be generally characterized as maximizing the convenience of the dentist. In this regard, the efficiency of the dental procedure is enhanced when the mechanisms for moving the chair permit the dentist to easily and precisely position and reposition the chair. Moreover, the chair should be configured to allow the dentist to assume a position close to the patient while the dentist remains seated.

SUMMARY OF THE INVENTION

This invention is directed to an improved dental chair for enhancing the patient's comfort and the dentist's convenience. As one aspect of this invention, the chair back and seat are configured and arranged so that whenever the chair is moved into a recumbent position the lumbar region of the patient's back is comfortably elevated.

The chair of the present invention is configured to provide the elevated lumbar support without the use of any cushion or pad as has been used in prior chairs for the purpose of providing lumbar support. The presence of such a pad is uncomfortable to a patient because a sitting patient's spine is not sufficiently arched to accommodate the pad.

The chair of the present invention includes mechanisms for controlling the relative movement of the chair back and seat so that the patient does not slide within the chair as the chair is moved from one position to another.

As another aspect of this invention, the chair is controlled by a microprocessor-based control system that includes input switches for initiating motion of the chair back or seat, sensing mechanisms for continuously providing signals representing the chair position, and actuators for moving the chair components under the control of the microprocessor.

The chair control system employs the sensing mechanisms in conjunction with a memory device for permitting a dentist to designate a particular position into which the chair will move any time a corresponding input switch is closed by the dentist.

The sensing mechanisms of the chair control system are configured and arranged to provide a high degree of sensitivity for monitoring the precise position of the chair. Moreover, the control system continuously monitors the operation of the chair to detect any malfunctioning components. Upon detection of such a malfunction, the control system generates and stores data representing the particular malfunctioning component. A portable diagnostic device is provided for converting this data into a visual display to assist a technician in servicing the chair.

As another aspect of this invention, the chair includes an armrest mechanism that allows an armrest to be pivoted out of the path of a patient who is entering or exiting a chair.

As another aspect of this invention, the chair includes a headrest position adjustment mechanism that includes a friction clamp that is adjustable so that the clamping force may be increased or decreased as necessary to ensure substantially effortless manual movement of the headrest.

The chair seat is mounted to a lift mechanism that permits the seat to be swiveled about a vertical axis. As another aspect of this invention, there is included a manually operated brake that permits infinitely variable resistance to the swiveling motion of the chair.

Many of the components for controlling movement of the chair are carried on a base upon which the chair seat rests. As another aspect of this invention, the chair seat is pivotally attached to a base so that the seat may be moved upwardly into a service position to expose the components carried on the base, thereby facilitating service of those components.

The present invention also includes a screw assembly that is adaptable for attaching accessory components to the dental chair. The screw assembly includes a self-storing handle that permits the screw assembly to be fastened to or removed from the chair without the use of tools.

DETAILED DESCRIPTION OF THE PREFERRED EMBODIMENT

The dental chair of the present invention is designed to be comfortable irrespective of the chair position. Moreover, the patient remains comfortable as the chair is moved from one position to another. The chair movement referred to here generally means the raising, lowering, and sloping of the chair seat, and the tilting of the chair back.

The dental patient's comfort is enhanced when (1) the lumbar region of the patient's back is sufficiently supported while the chair is in a recumbent position, and (2) movement of the chair components relative to the patient is such that sliding of the patient within the chair is minimized. The dental chair of the present invention is constructed in a manner such that the movement of the chair back relative to the seat is controlled so that the chair back provides adequate support for the lumbar region of the patient's back while the chair is in the recumbent position. In this regard, the lower portion of the chair back (that is, the portion of the chair back nearest the seat) assumes a slightly raised position relative to the chair seat as the chair back moves into the recumbent position. Moreover, the motion of the back and seat generally conforms to the natural motion of the patient in moving between a sitting and a recumbent position. Accordingly, sliding of the patient within the chair is minimized.

Figure 1A:
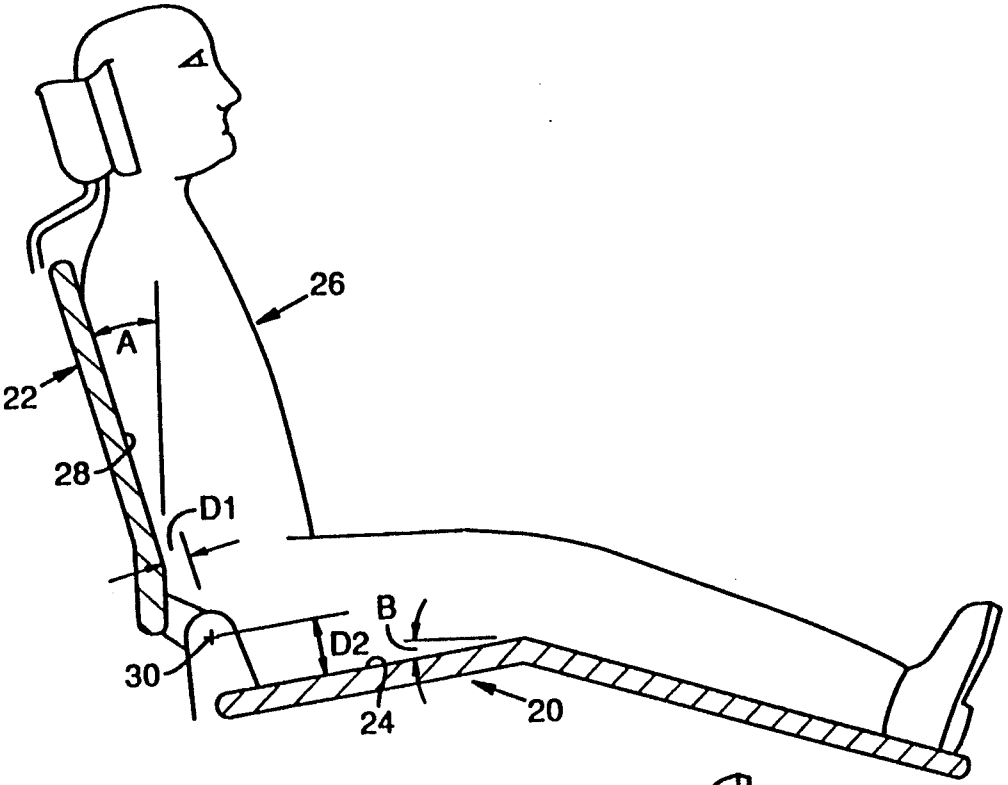
FIGS. 1A and 1B are diagrams illustrating two positions of the seat and back of a chair formed in accordance with the present invention.
Figure 1B:
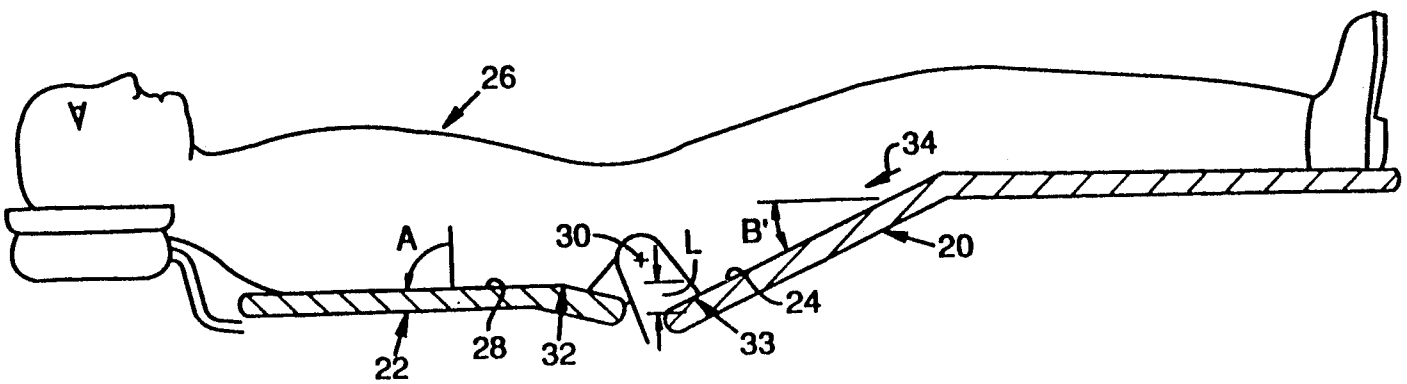

FIGS. 1A and 1B are diagrams of the components of the present invention that provide the patient-comfort features just mentioned. Specifically, FIGS. 1A and 1B represent a cross-sectional view taken through the center of the chair seat 20 and chair back 22. The seat 20 includes a generally flat seating surface 24 upon which a patient 26 sits. The chair back 22 includes a generally flat resting surface 28 upon which the patient 26 is able to rest his back.

The inclination of the resting surface 28 relative to vertical is represented by a tilt angle A. Whenever the chair is in the sitting position (FIG. 1A), the tilt angle A is approximately 13° from vertical. Whenever the chair is in the recumbent position (FIG. 1B), the tilt angle A is approximately 90° from vertical.

As described more fully below, the chair seat 20 and back 22 are mechanically linked so that the back 22 pivots about an axis 30 in moving between the sitting position and the recumbent position. The pivot axis 30 appears as a point in FIGS. 1A and 1B because it is oriented perpendicular to the plane of those figures. The location of the pivot axis 30 is selected so that in moving from the sitting to the recumbent position, the chair back 22 will swing into a position that supports the lumbar region 32 of the patient in a position that is raised relative to the patient's buttocks 33.

The distance L (FIG. 1B) represents the magnitude of the lumbar support (hereinafter referred to as "loft") as the vertical distance between the chair back resting surface 28 and the seating surface 24 measured where the seat 20 and back 22 are closest in the recumbent position of the back. The loft L is established as a result of the pivot axis 30 being nearer to the plane of the chair resting surface 28 than to the plane of the seating surface 24. As used here, the "plane" of the seating surface 24 or of the resting surface 28 is the central planar region of the respective surface (FIGS. 1A and 1B). The shortest distance between the pivot axis 30 and the plane of the resting surface 28 is represented as D1 in FIGS. 1A and 1B, and the shortest distance between the pivot axis 30 and the plane of the seating surface 24 is represented as the distance D2. The magnitude of the loft L is the difference between the vertical components of distances D2 and D1 when the chair is in the recumbent position.

In a preferred embodiment, the pivot axis 30 is located so that the distance D1 is about 1.5 inches, and the distance D2 is about 2.5 inches, resulting in a loft of one inch. A one-inch loft is preferred for patient comfort. It can be appreciated that the distances D1 and D2 may be selected to establish the magnitude of the loft L at any desired level.

The above-described pivot axis 30 is located such that it generally aligns with the base of a seated patient's spine. Consequently, the motion of the chair back 22 generally follows the natural spinal arching about the base of the spine that occurs when a person moves from a sitting to a recumbent position. Accordingly, there is little relative movement between the chair back 22 and the patient 26 as the chair is moved between the sitting and the recumbent positions. Put another way, the patient does not slide against the moving chair back 22.

The pivot axis and chair arrangement of the present invention is such that the loft L is established only as the chair back 22 moves into the recumbent position (FIG. 1B). Whenever the chair back 22 is in the sitting position (FIG. 1A), the patient's back is supported in a natural, generally straight position since the portion of the chair resting surface 28 that extends adjacent to the patient's spine is generally planar. The present invention does not employ a cushion or pad as has been used in prior chairs for the purpose of providing lumbar support in the recumbent position of the patient. The presence of such a pad is uncomfortable to a sitting patient because the spine is not sufficiently arched to accommodate the pad.

Whenever a dental chair is moved from the sitting position to the recumbent position, the patient's legs tend to slide along the seating surface 24 in a direction, represented by arrow 34 (FIG. 1B), that is generally parallel to the seating surface 24. The sliding is generally attributable to the rotation of the patient's pelvis, which rotation moves the patient's hip socket in a direction that includes a component in the direction of arrow 34. The greatest amount of leg sliding occurs as the chair back tilt angle A increases from 82° to 90° from vertical, that is, during the last 8° of chair back travel in moving to the recumbent position.

The chair of the present invention includes mechanisms for minimizing the extent of the just-mentioned leg sliding along the seating surface 24. In this regard, the angle that the seating surface 24 is sloped from horizontal, which slope is represented by slope angle B in FIG. 1A and B' in FIG. 1B, is increased to compensate for the pelvic rotation. More particularly, as the chair is moved into the recumbent position, the slope angle B of the seating surface 24 is increased from approximately 7° at the sitting position to approximately 22° at the recumbent position B'. This gradual increase in slope angle B minimizes leg sliding to enhance patient comfort within the chair.

The mechanisms for accomplishing the patient-comfort features discussed above will now be described with particular reference to FIGS. 1-5.

The seat 20 includes a rigid seat board 36 (FIGS. 3, 4) that has on its underside 37 two edge rails 38. The rails 38 extend along the sides of the board 36 and have generally rectangular cross sections. The seat board 36 is bent downwardly near its midpoint. The bend 40 in the seat board 36 defines a front part 41 of the board 36 and a rear part 43 of the board. The front part 41 is inclined relative to the rear part 43 by an angle of about 155. The seat board 36 is covered with a firm cushion 42 (see FIG. 2) that defines the seating surface 24.

Figure 3:
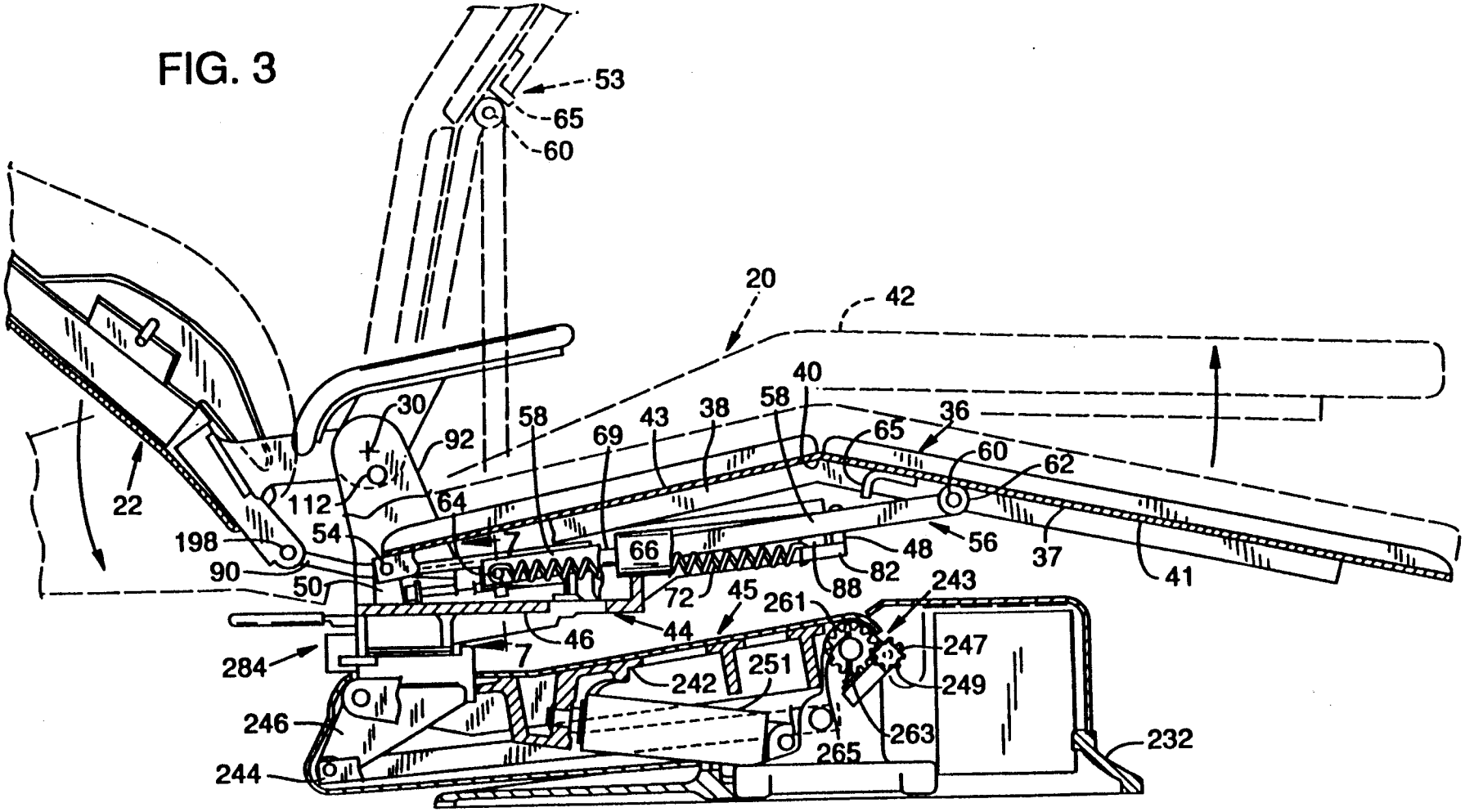
FIG. 3 is a side elevation view, in partial cross-section, showing the chair with some of the exterior cushioning appearing in dashed lines.
Figure 5:
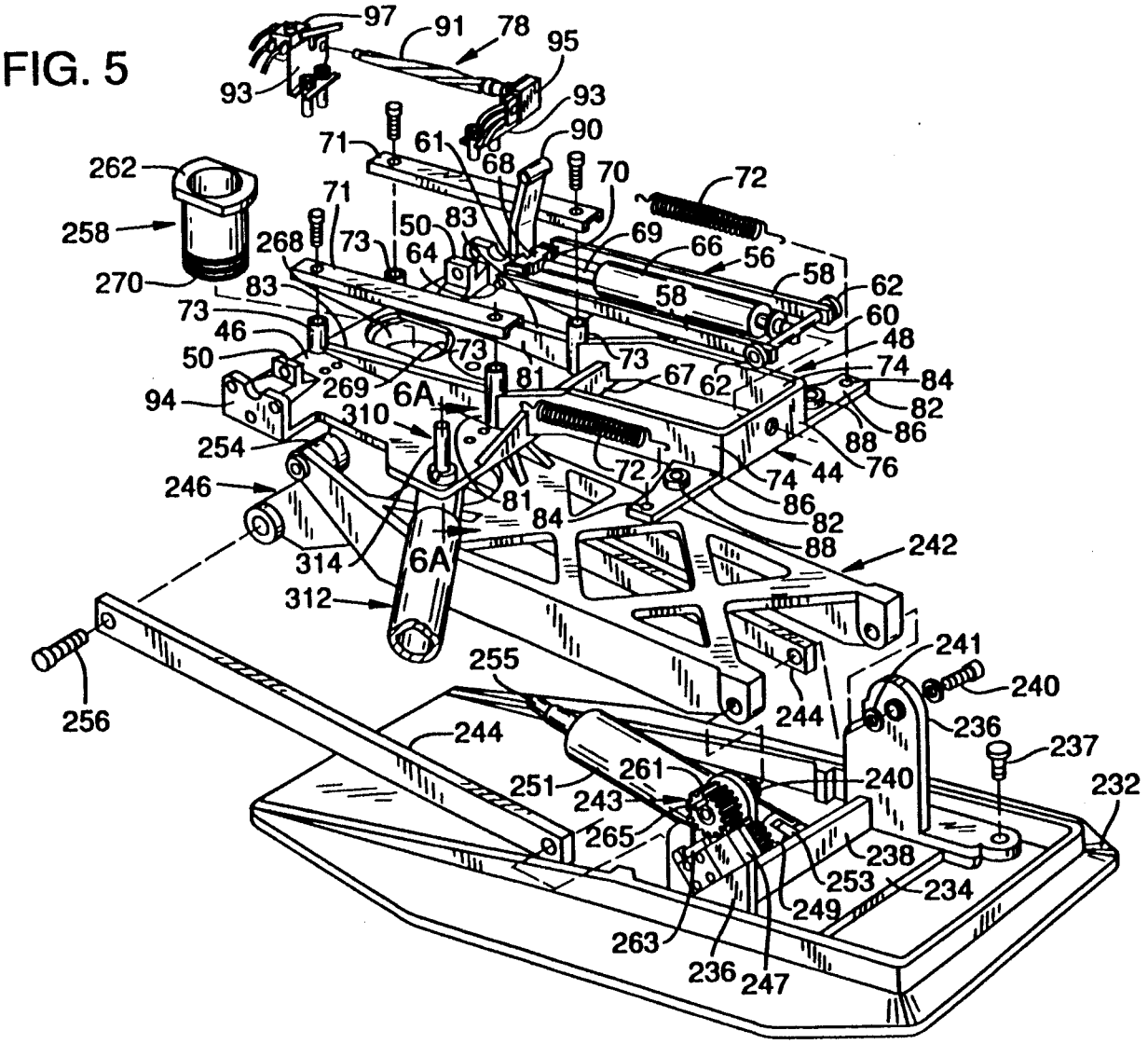
FIG. 5 is an exploded perspective view depicting the mechanisms for moving the chair in accordance with the present invention.

The seat 20 is pivotally attached to, and rests upon, a rigid seat base 44 that is carried by a lift system 45. The lift system 45 includes means for lifting and swiveling the chair as described more fully below. As best shown in FIG. 5, the seat base 44 includes a generally flat support plate 46, and an attached cylinder bracket 48. The rearward (that is, toward the left in FIG. 3) end of the support plate 46 includes two upwardly extending pivot brackets 50. The brackets 50 are spaced apart a distance slightly wider than the distance between the rails 38 of the seat board 36. The rearward ends 52 of the rails 38 are pivotally attached to the pivot brackets 50 by pivot pins 54 (FIG. 3). As will be described, this pivotal connection of the seat board 36 to the seat base 44 permits the seat 20 to be swung upwardly into a service position (shown generally at 53 in dashed lines in FIG. 3) that permits access to the seat base 44 to service the components carried on the seat base and allows swinging movement of an accessory arm 312 that is attached to the seat base as described below.

The underside 37 of the forward part 41 of the seat board 36 rests upon a roller mechanism 56 that is driven to change the slope angle B of the seat 20. The roller mechanism 56 includes a pair of spaced-apart link arms 58 that are connected at their forward ends by an axle 60. A roller 62 is mounted to each end of the axle 60 near each link arm 58. The rollers 62 are sized so that the seat board underside 37 rests upon the curved surface of the rollers 62.

The rearward ends of the link arms 58 include apertures through which pass an elongated, rigid connecting rod 64. The rod 64 is connected at its center to a hydraulically driven "tilt" cylinder 66 that is mounted to the seat base 44. The rod 64 is moved by the tilt cylinder 66 in a direction that is perpendicular to the longitudinal axis of the rod 64. The connecting rod 64, in addition to driving the roller mechanism 56 to change the slope angle B of the seat 20, is linked to the movable chair back 22 for moving the back to change the tilt angle A as described later.

The roller mechanism 56 is useful for supporting the seat 20 in the service position mentioned above. In this regard, the rearward ends of the link arms 58 are pivotally connected to the connecting rod 64 so that the axle 60 may be swung upwardly from the seat base 44. Accordingly, after the seat 20 is swung into the service position, the axle 60 is movable to a position just under a catch 65 (FIG. 3) that protrudes from the front part 41 of the seat board underside 37. The seat board 36 is then lowered slightly until the catch 65 is supported upon the axle 60.

The rearward end of the tilt cylinder 66 rests upon a gusset plate 67 (FIG. 5) that protrudes upwardly from the forward edge of the seat base support plate 46 (FIG. 5). The tilt cylinder piston rod 69 extends from the rearward end of the tilt cylinder 66 and carries on its outer end a clevis bracket 68.

Figure 7:
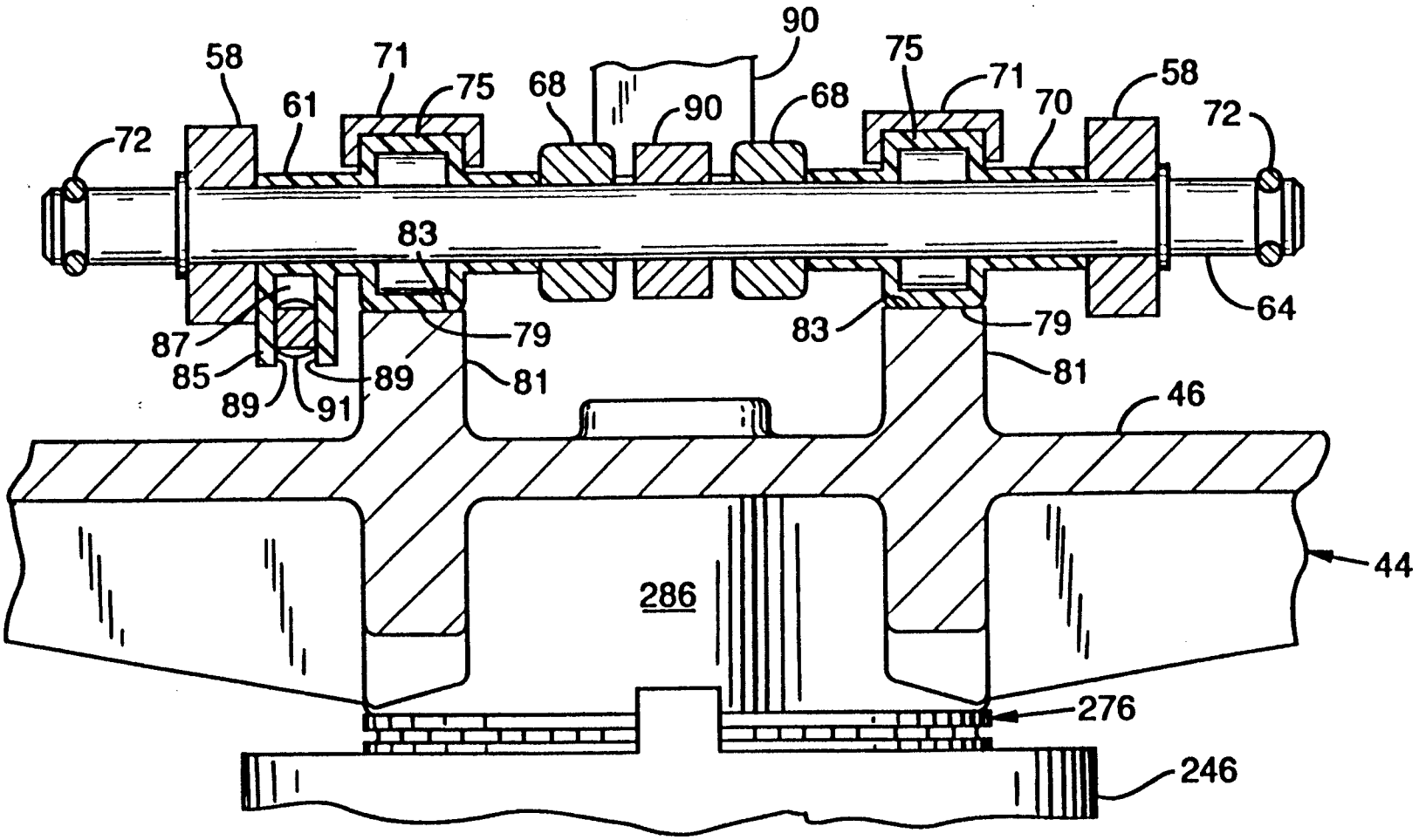
FIG. 7 is an enlarged cross-sectional view taken along line 7—7 of FIG. 3.

As best shown in FIG. 7, the center of the connecting rod 64 passes through the clevis bracket 68. The connecting rod 64 also passes through two slide blocks 61, 70 that are formed of low-friction material, such as a composite of nylon, glass and a polytetrafluoroethylene material such as that manufactured under the trademark TEFLON by E. I. DuPont de Nemours & Co. The blocks 61, 70 are positioned on opposing sides of the clevis bracket 68 between the link arms 58.

A pair of guide rails 81 protrudes upwardly from the support plate 46. Each slide block 61, 70 is formed with a downwardly-facing sliding surface 79 that rests upon one of the pair of guide rails 81. Whenever the connecting rod 64 is reciprocated by the tilt cylinder 66, each slide block 61, 70 slides along an associated upper surface 83 of a guide rail 81.

The slide blocks 61, 70 are secured against movement away from its associated guide rail 81 by a pair of guide channels 71 mounted to extend one above each of the guide rails 81. In this regard, posts 73 extend upwardly from the forward and rearward end of each guide rails 81 (FIG. 5). A guide channel 71 is fastened between the two posts 73 of a guide rail 81. Each guide channel 71 is mounted to open downwardly and to receive a lug 75 that protrudes from each slide block 61, 70 to fit within the guide channel 71 (FIG. 7).

The slide block 61 is associated with a tilt-position sensing mechanism 78 (FIG. 5) for generating tilt-position signals that represent the instantaneous position of the connecting rod 64, which position is correlated to the magnitude of the tilt angle A and of the slope angle B. More particularly, an integrally formed yoke 85 (FIG. 7) protrudes downwardly from the slide block 61 along one side of the guide rail 81. The yoke 85 includes a slot 87 that is defined in part by two flat spaced-apart sidewalls 89. The yoke 85 engages an elongated helical bar 91 that is rotatably mounted by brackets 93 to extend along the linear path defined by movement of the yoke 85 as the connecting rod 64 is reciprocated by the tilt cylinder 66. The bar 91 is formed from a bar having a square cross-section sized to fit closely between the sidewalls 89 of the yoke 85.

In view of the construction just described, it can be appreciated that the reciprocating movement of the connecting rod 64 will cause the yoke 85 to slide along the helical bar 91, thereby transferring the translational motion of the connecting rod into rotation of the bar 91. The forward end of the bar 91 is coupled to a conventional potentiometer 95 (FIG. 5). The output signals (i.e., the tilt-position signals) of the potentiometer 95 are applied to a hereafter-described dental chair control system 400.

It is noteworthy here that the helical bar 91 may be formed with a pitch that is small enough to cause rotation of the bar 91 (hence, the generation of detectable output signals by the potentiometer 95) in response to minute movement of the connecting rod 64. In short, the sensitivity of the tilt-position sensing mechanism 78 may be established as desired by forming the bar 91 with the appropriate pitch.

A normally closed tilt-limit switch 97 is carried by the bracket 93 to which the rearward end of the rod 91 is mounted. The tilt-limit switch 97 is activated by contact with the slide block 61 whenever the connecting rod 64 is moved to its rearward-most position by the tilt cylinder 66. As will become clear upon reading this description, the rearward-most position of the connecting rod 64 represents the sitting position of the chair. Accordingly, the tilt-limit switch 97 is opened whenever the chair back 22 reaches the full upright (i.e., sitting) position. The output of the tilt-limit switch 97 is applied to the control system 400 described below.

The outermost ends of the connecting rod 64 are peripherally grooved, each grooved end receiving a hooked rearward end of a tension spring 72. The forward ends of the tension springs 72 and the forward end of the tilt cylinder 66 are attached to the cylinder bracket 48 of the seat base 44. In this regard, the bracket 48 includes two spaced-apart sidewalls 74 and a web 76 that interconnects the forward ends of the sidewalls. The forward end of the tilt cylinder 66 is attached to the web 76.

A rigid extension 82 protrudes outwardly from each side of the forward end of the cylinder bracket 48. The outermost end of each extension 82 includes an aperture 84 for receiving the forward, hooked end of one of the tension springs 72.

Each extension 82 also includes a generally horizontal surface 86. On each surface 86, there is mounted a wear pad 88 upon which rests a link arm 58. The link arms 58 slide along the wear pads 88 as the connecting rod 64 is reciprocated by the tilt cylinder 66. The relative elevation of the wear pads 88 and pivot brackets 50 is established so that when the chair is in the sitting position (that is, with the connecting rod 64 in its rearward-most position), the seating surface 24 is at a slope angle B of about 7° from horizontal (FIG. 1A).

Whenever the tilt cylinder 66 is not driven, the tension springs 72 pull the connecting rod 64 forwardly and the tilt cylinder piston rod 69 retracts. The forward-most position of the connecting rod 64 places the chair back 22 in the recumbent position (FIG. 1B). Moreover, as the connecting rod 64 moves forwardly, the rollers 62 roll along the front part 41 of the underside 37 of the seat board 36 to force the seat 20 to pivot upwardly about the pivot pins 54 at the rearward end of the seat 20. The length of the link arms 58 and of the tilt cylinder stroke are selected so that the roller mechanism 56 will move the seat board 36 in a manner such that the seating surface 24 attains slope angle B' of approximately 22° from horizontal as the connecting rod 64 is pulled into its forward-most position.

As noted, the tilt cylinder 66 is the actuator for moving the chair back 22 between the sitting and the recumbent positions. In this regard, the back 22 is pivotally mounted to the seat base 44 to pivot about the axis 30 by mechanisms to be described and including a link 90 connected to the back 22, as best seen in FIG. 3. As the tilt cylinder 66 pivots the connecting rod 64, the rod motion is transferred to the chair back 22 by the link 90 to generate the pivotal movement of the chair back 22.

Figure 8:
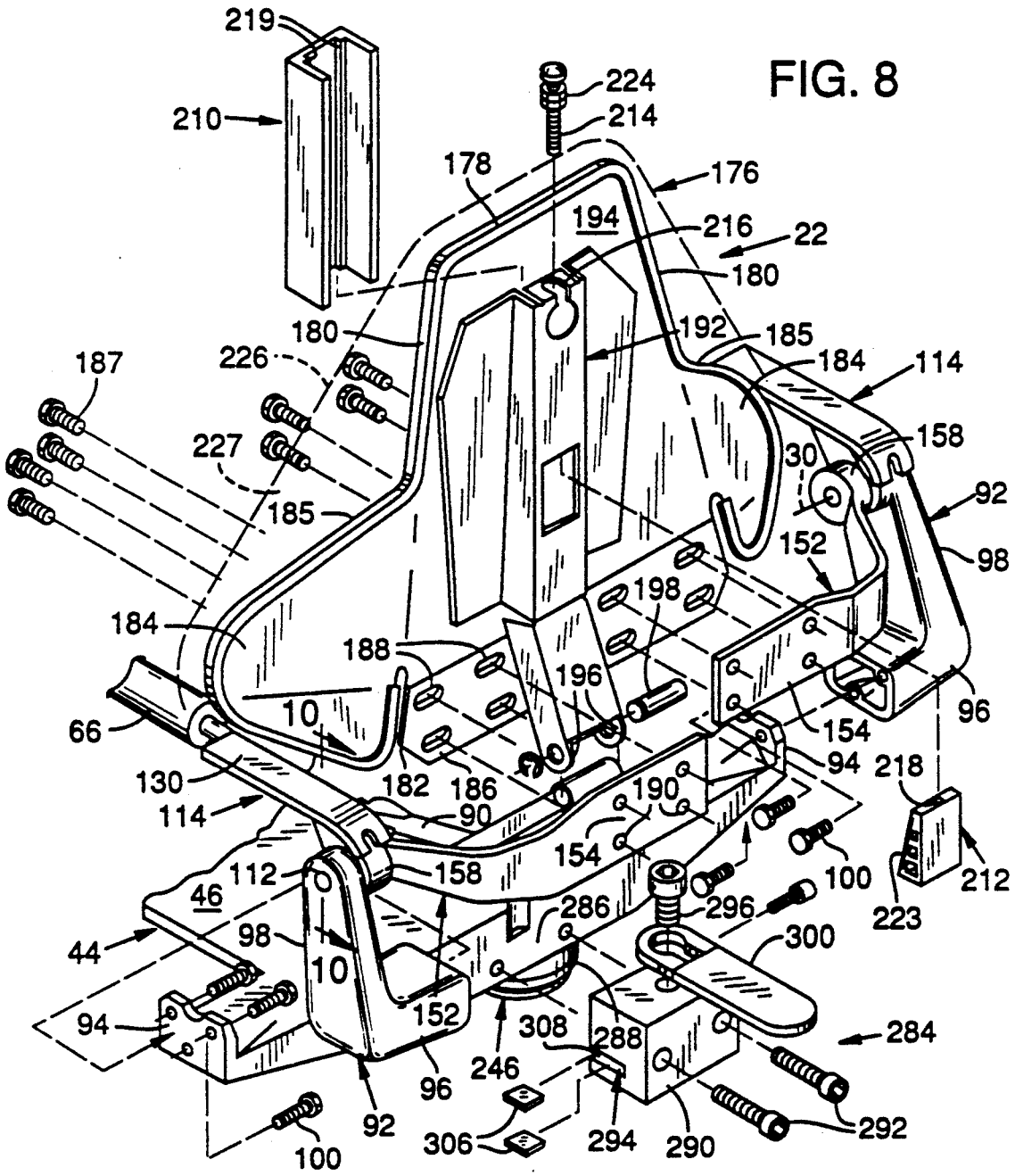
FIG. 8 is an exploded perspective view of the chair back and the components for providing the pivotal connection between the chair back and seat.
Figure 9:
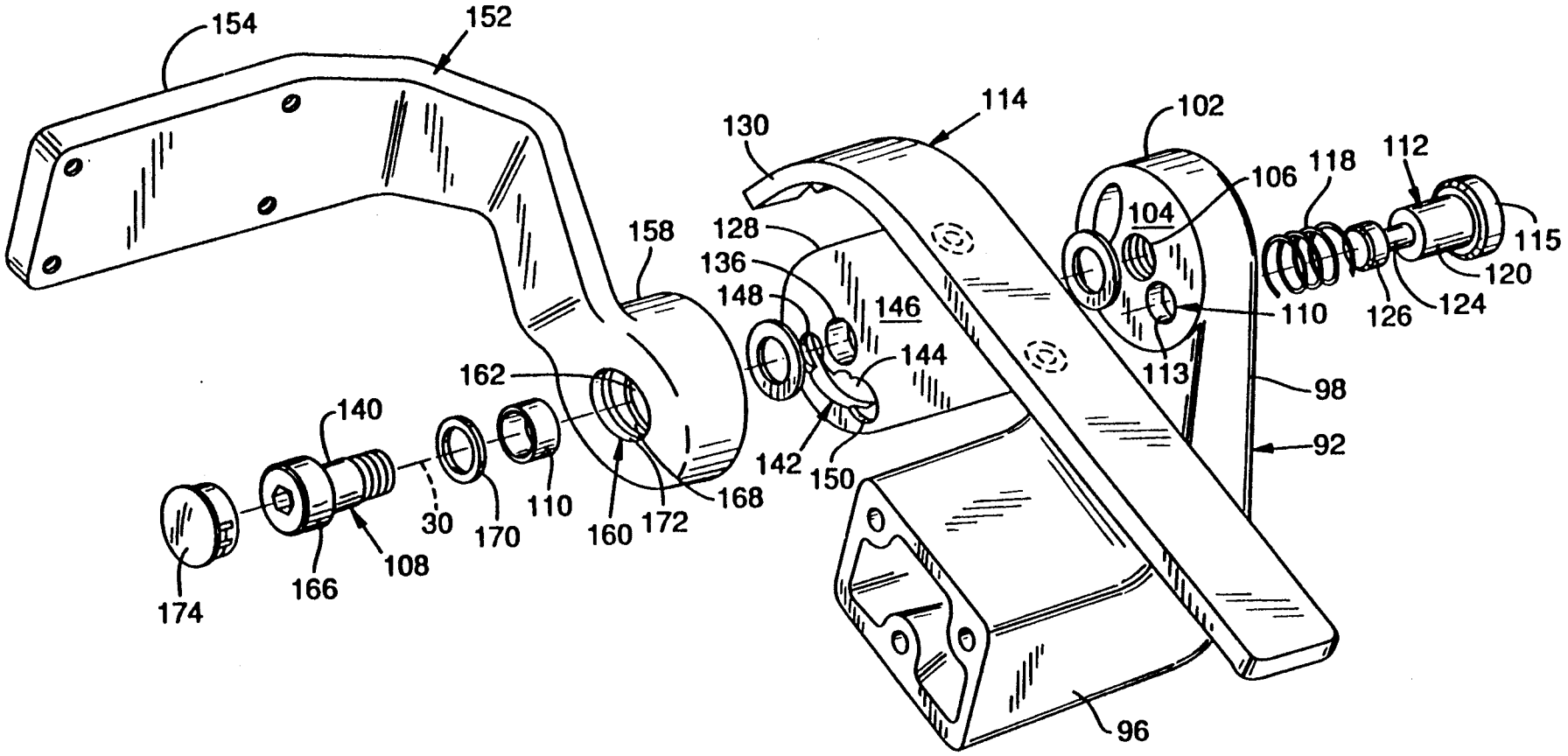
FIG. 9 is an exploded perspective view of an armrest bracket and associated mechanisms for permitting the armrest to be swung between two positions.

With reference to FIGS. 8 and 9, the mechanism for pivotal connection of the back 22 to the seat base 44 includes two rigid arm supports 92 that are mounted to flat brackets 94 that protrude upwardly from each rearward corner of the seat base support platform 46. Each arm support 92 is L-shaped and has a generally horizontal leg 96 and an upwardly extending vertical leg 98. The horizontal leg 96 is fastened, via fasteners 100, to the brackets 94 on the support plate 46. As best shown in FIG. 9, the vertical leg 98 has a rounded upper end 102 that is formed with a flat circular inner surface 104. The upper end 102 of the arm support 92 includes a central aperture 106 that extends into the inner surface 104 but not completely through the upper end 102. The aperture 106 is threaded to receive the threaded end of a shoulder-type pivot screw 108. The pivot axis 30 is defined by the central axis of the pivot screw 108.

The pivot screw 108 connects a rigid back support 152, which is fastened to and extends from the chair back 22, to the arm support 92. Also supported on the pivot screw 108 is an armrest 114 that is positioned between the back support 152 and the arm support 92. Moreover, the chair armrest 114 is pivotal about the pivot axis 30 so that the armrest may be moved to a location that does not interfere with movement of the patient into and out of the dental chair. The movable armrest aspect of the present invention is described next with reference to FIGS. 9 and 10.

A second hole 110 is formed through the upper end 102 of each arm support 92. A spring-biased release button 112 passes through the hole 110 and may be pressed to release the dental chair armrest 114 so that the armrest may be swung about the pivot screw 108. In this regard, the hole 110 includes a countersunk portion 111 that extends into the arm support 92 from the outer surface 116 of the arm support upper end 102. The inner portion 113 of the hole 110, which has a smaller diameter than the countersunk portion 111, extends from the inner end of the countersunk portion through the inner surface 104.

Figure 10:
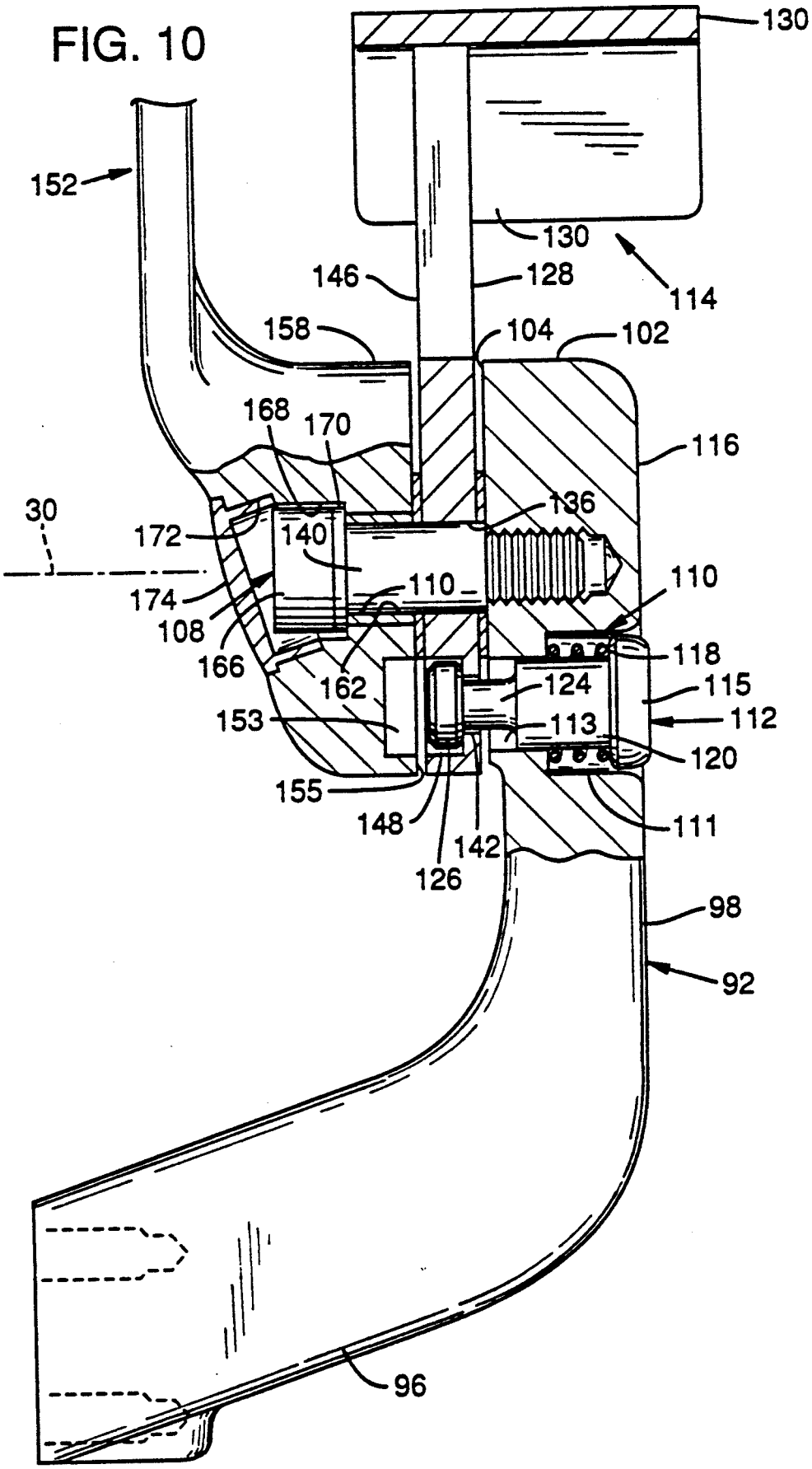
FIG. 10 is a detail view partly in cross-section taken along line 10—10 of FIG. 8 showing the pivotal connection between the chair seat and back.

A compression spring 118 is housed within the countersunk portion 111 of the hole 110 (FIG. 10). The release button 112 includes a cylindrical central part 120 that fits through the compression spring 118. The spring 118 bears against the head 115 that is formed on the outer end of the release button 112. Accordingly, the spring 118 normally urges the button outwardly toward a position where the button head 115 is near the outer surface 116 of the arm support upper end 102.

Figure 2:
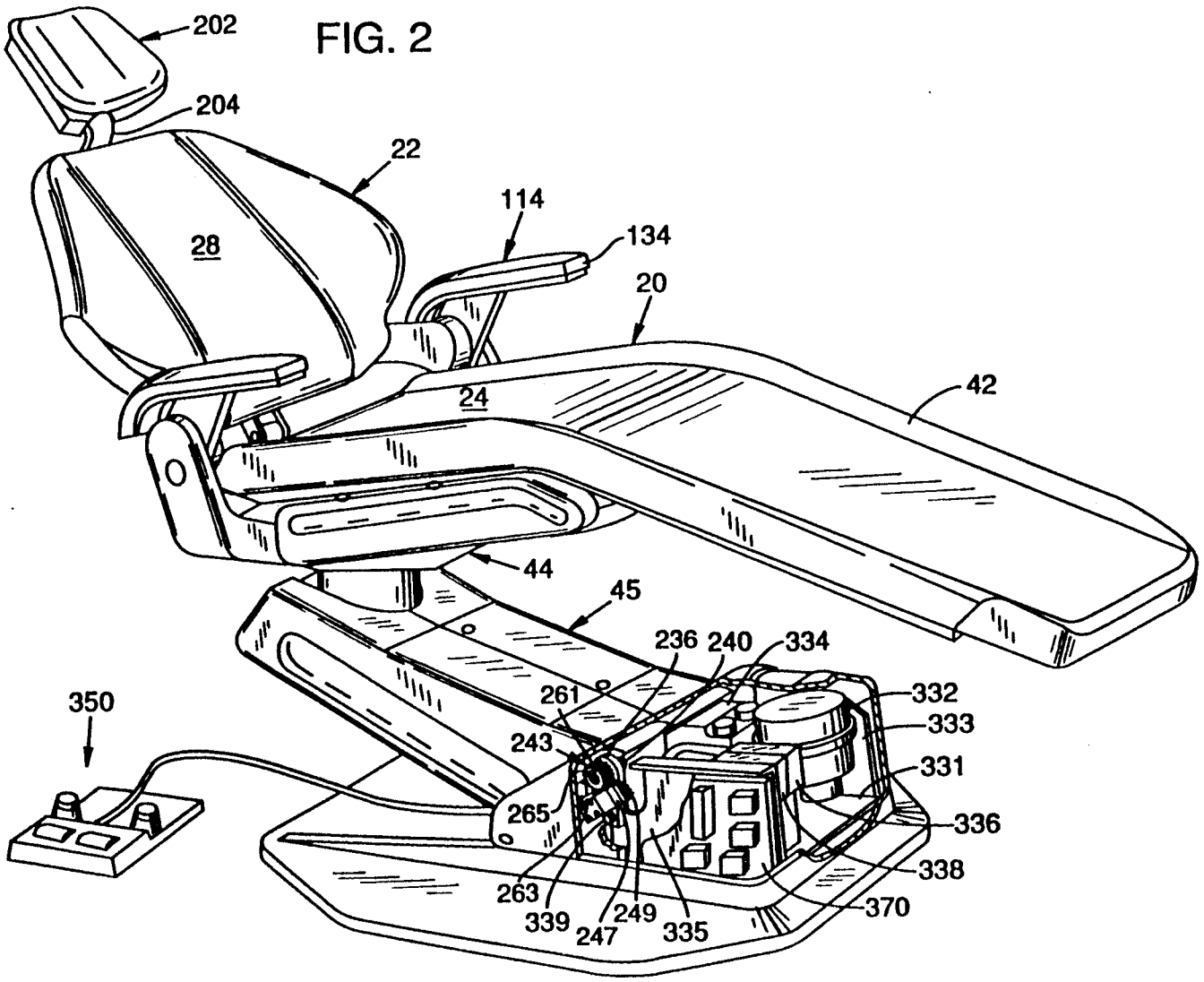
FIG. 2 is a perspective view of a chair formed in accordance with the present invention.

A small-diameter neck part 124 extends inwardly from the central part 120 of the release button 112 and terminates in a cylindrical detent head 126 that has a diameter that is slightly smaller than the inner portion 113 of the hole 110. The detent head 126 of the release button 112 is normally disposed adjacent to the inner surface 104 of the arm support upper end 102 for the purpose of securing the armrest 114 in a selected position. In this regard, the armrest 114 includes a pivot plate 128 and attached rest plate 130. The rest plate 130 has a generally flat surface 132 that is covered with a cushion 134 (FIG. 2). The pivot plate 128 is attached, as by welding, to the underside of the rest plate 130. The outer end of the pivot plate 128 is rounded and includes a clear pivot hole 136 through which passes the pivot screw 108. The pivot screw 108 is sized so that part of its smooth mid-portion 140 extends completely through the pivot hole 136 in the armrest pivot plate 128 (FIG. 10). Consequently, the armrest 114 is able to pivot about the pivot screw 108.

An arcuate, elongated slot 142 is formed in the pivot plate 128 coaxial with the pivot screw 108. The longitudinal axis of the slot 142 and the central axis of the release button 112 are established at the same radial distance from the pivot axis 30 of the pivot screw 108. The width of the slot 142 is less than the diameter of the detent head 126 of the release button 112. A curved clearance notch 144 (see FIG. 9) is formed on one side of the slot 142 for the purpose of permitting the detent head 126 to pass through the slot 142 at the time the armrest pivot plate 128 is assembled against the inner surface 104 of the arm support upper end 102.

The armrest assembly technique includes tilting the pivot plate 128 while the plate is moved toward the inner surface 104, and while the release button 112 is pressed so that the detent head 126 and neck part 124 protrude inwardly. With the pivot plate 128 so tilted, the detent head 126 is able to pass through the slot 142 at the location where the slot is widened by the clearance notch 144. After the detent head 126 is through the slot 142, the pivot plate 128 is moved against the inner surface 104 so that the inside surface 146 of the pivot plate is in a plane that is perpendicular to the central axis of the release button 112. This relative orientation of the pivot plate 128 and release button 112 (that is, the assembled orientation of the armrest) prohibits the detent head 126 from moving back through the slot 142.

Curved recesses 148, 150 are formed in the pivot plate inside surface 146 at each end of the slot 142. The recesses 148, 150 are sized to receive the detent head 126 of the release button 112. Whenever the detent head 126 is seated within a recess 148 or 150, the armrest 114 is locked, unable to pivot about pivot screw 108. As the head 115 of the release button 112 is depressed, the detent head 126 is moved out of recess 148 or 150 and into a clearance hole 153 formed in the outer surface 155 of the back support 152. Accordingly, the small diameter neck part 124 fits into the slot 142 so that pivotal movement of the armrest 114 is no longer restricted. The armrest 114 may then be swung about pivot axis 30 until the detent head 126 is received in the other recess 150. The compression spring 118 keeps the detent head 126 within the recess 150 until the release button 112 is again pressed.

Preferably, the slot 142 and recesses 148 and 150 are arranged so that the armrest 114 will assume a rest position (FIGS. 2 and 10) when the detent head 126 is in the recess 148, and a lowered or exit position (dashed lines in FIG. 12) whenever the detent head 126 is in the other recess 150. The rest position permits the armrest 114 to be used as a conventional armrest for a sitting patient. The exit position locates the armrest 114 so that it extends downwardly, thereby providing for the patient easy entry and exit from the chair. Moreover, with the armrest 114 in the exit position, it is easy to drape the patient and chair (as is often required for oral surgery) because the armrest 114 does not protrude beyond the patient.

With particular reference to FIGS. 8, 9 and 10, the chair back 22 is pivotally connected to the arm supports 92 by the above-mentioned back supports 152 that are fastened to extend from each side of the chair back. Each back support 152 is a rigid member that includes a generally flat part 154 on one end, and a generally cylindrical pivot head 158 formed on the opposing end. An aperture 160 is formed in the pivot head 158 to accommodate the pivot screw 108. More particularly, the aperture 160 is bored to include three contiguous sections for receiving the pivot screw 108 (FIGS. 9 and 10). The inner section 162 is sized to receive the smooth mid-portion 140 of the pivot screw 108, with the mid-portion surrounded by a sleeve bearing 110. The head 166 of the pivot screw 108 and a washer 170 fit into the middle section 168 of the aperture 160. The outer section 172 of the aperture 160 receives a cap 174 for covering the pivot screw head 166.

As best shown in FIGS. 8 and 9, the back support 152 is bent so that the flat part 154 on the end of the back support 152 extends behind and is fastened to a back plate 176 that comprises the primary structural component of the chair back 22. The back plate 176 is shaped with relatively narrow (as measured from side to side) top edge 178. The side edges 180 of the back plate 176 gradually diverge downwardly from the top edge 178. At a location approximately midway between the top edge 178 and the bottom edge 182 of the back plate 176, the side edges 180 extend outwardly and forwardly to define wings 184 that provide support for an elbow rest for the patient when the chair is in a recumbent position.

A mounting plate 186 is fastened to extend across the back plate 176 near the bottom edge 182. The mounting plate includes apertures 188 that align with apertures 190 formed in the flat parts 154 of the back supports 152. The flat parts 154 are fastened to the mounting plate 186 with fasteners 187 that extend through those apertures 188, 190. The back supports 152 and arm supports 92 are configured and arranged to define the above-described location of the pivot axis 30 relative to the chair seat 20 and back 22 so that the loft L will be established as the chair assumes the recumbent position. It is contemplated that the chair back 22 and seat connection may be accomplished by linking mechanisms other than the mechanisms just described, but that still generate the loft L as taught by the present invention.

An elongated channel bracket 192, see FIG. 8, is fastened to the rearward surface 194 of the back plate 176. The channel bracket 192 extends along the center of the back plate 176 from near the top edge 178, across the mounting plate 186, to protrude beyond the bottom edge 182 of the back plate. The lower end of the channel bracket 192 includes two tabs 196 having holes for receiving a pivot pin 198 that engages the rearward end of the above-mentioned link 90. Accordingly, the link 90 is pivotally connected to the chair back plate 176 at the lower end of the channel bracket 192. As mentioned earlier, the forward end of the link 90 is pivotally connected to the connecting rod 64 that is driven by the tilt cylinder 66. Accordingly, the tilt cylinder 66 drives the link 90 to tilt the connected chair back 22 about the pivot axis 30 that is defined by the coaxial central axes of the pivot screws 108.

It is convenient here to describe two features of the present invention that further enhance the comfort of the patient and the convenience of the dentist. One feature pertains to the adjustment of the position of the chair headrest 202 relative to the chair back 22. Referring to FIGS. 8 and 11, the headrest 202 is secured to the upper end of a rigid glide bar 204, the lower portion 208 of which extends along the back plate 176 parallel thereto.

The glide bar portion 208 is releasably clamped to the back plate 176 by a friction clamp mechanism which includes a smooth-surfaced guide channel 210 attached by fasteners 211 to the rearward surface 194 of the back plate 176 inside the upper end of the channel bracket 192. The guide channel 210 opens outwardly from the rearward surface 194 of the back plate 176. Preferably, the guide channel is made of low-friction material, such as that manufactured under the trademark DELRIN by E. I. DuPont de Nemours & Co.

The portion 208 of the glide bar 204 fits within the space between the guide channel 210 and the channel bracket 192. The end 208 is clamped against the guide channel by a rigid wedge 212. The wedge 212 is disposed within the channel bracket 192 and supported from the top of the bracket by a threaded fastener 214. The head of the fastener 214 is carried on a slotted tab 216 that is formed to extend across the upper end of the channel bracket 192. The threaded end of the fastener 214 engages a correspondingly threaded hole 218 that is formed in the upper, relatively narrow end of the wedge 212.

Figure 11A:
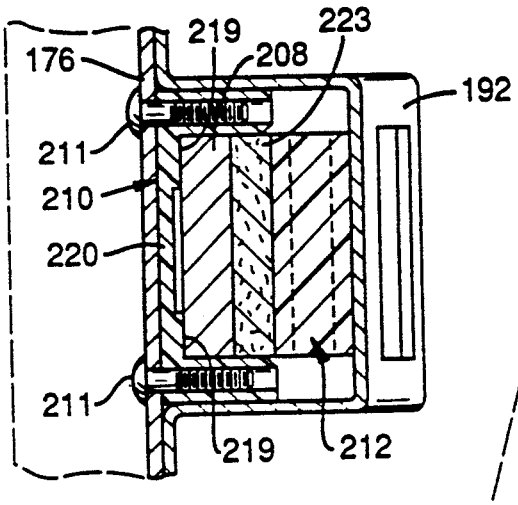
FIG. 11A is a cross-sectional view taken along line 11A—11A of FIG. 11.
Figure 11:
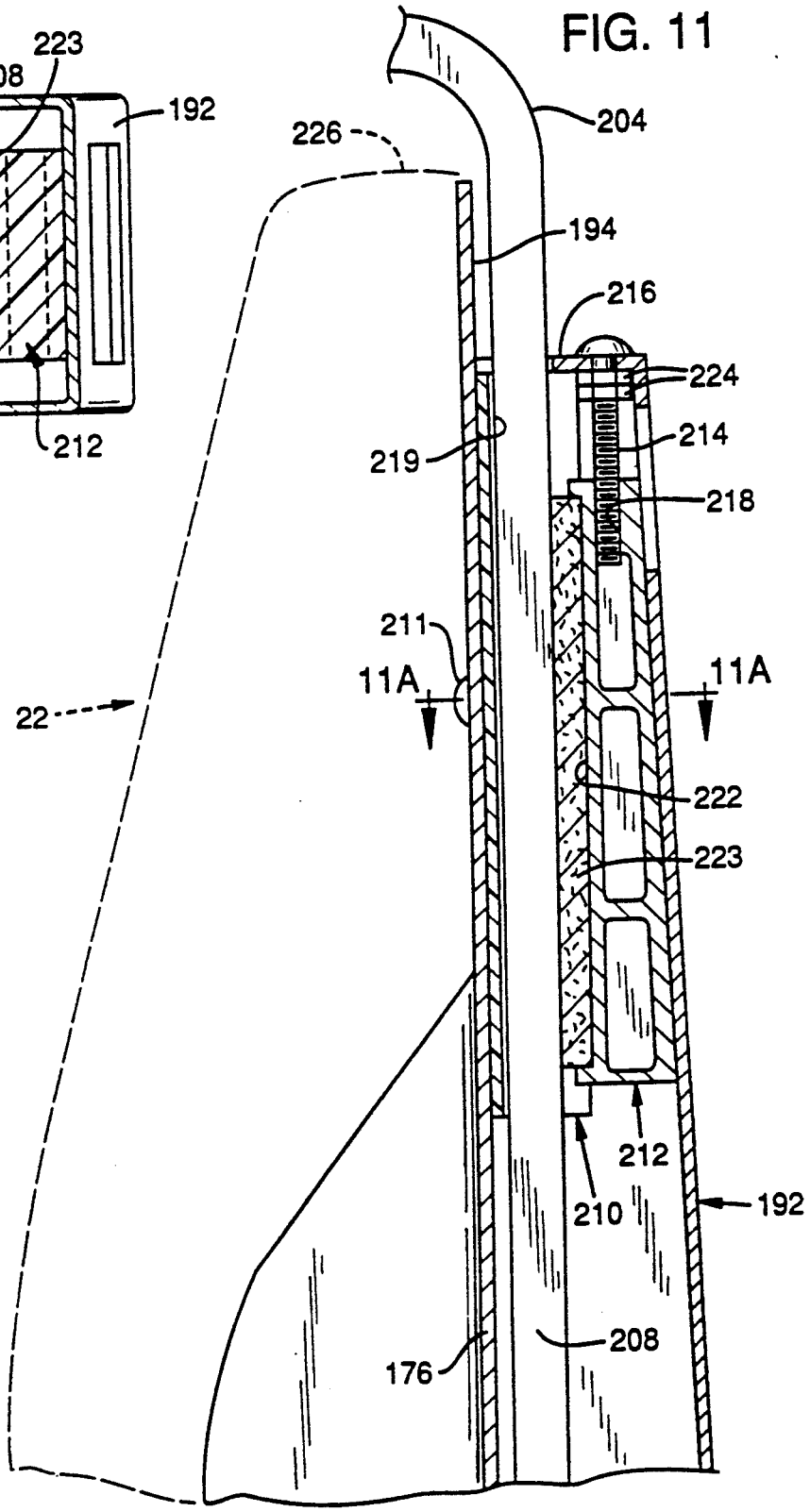
FIG. 11 a cross-sectional view of a friction clamp mechanism for securing the headrest of the chair to the back of the chair.

As best shown in FIG. 11A, the glide bar portion 208 is clamped between two raised strips 219 in the base surface 220 of the guide channel 210 and the inner face 222 of the wedge 212. Preferably, the wedge face 222 is covered with nonabrasive material such as a felt strip 223. The channel bracket 192 is shaped with gradually tapering depth from bottom to top. Accordingly, whenever the fastener 214 is threaded into the wedge 212, the wedge will be drawn upwardly against the bracket 192 and urged toward the raised strips 219 of the guide channel 210. Preferably, the amount of friction force that is applied by the wedge 212 to the glide bar portion 208 as the fastener 214 is rotated is selected so the headrest position may be changed whenever the dentist slides the headrest 202 by hand. Two nuts 224 are provided on the fastener 214 for locking together the fastener 214 and the channel bracket 192 to maintain the desired level of force for clamping the headrest in place. In the event of wear or other factors that cause the clamping force level to change, the fastener 214 may be unlocked and rotated to adjust the clamping force level to that desired.

Figure 12:
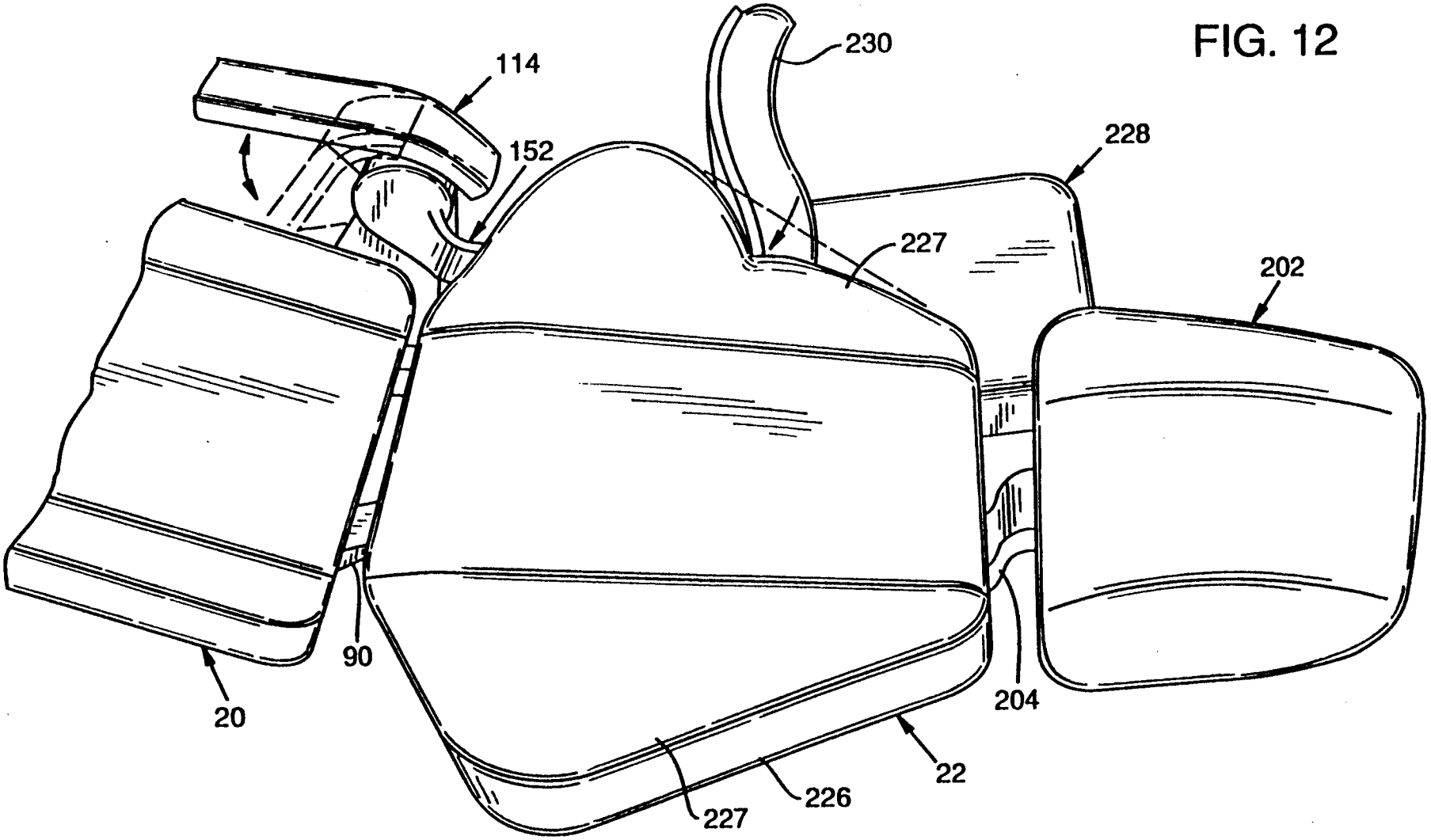
FIG. 12 is a pictorial view of the chair back in the recumbent position illustrating a portion of the chair back that is deformable to permit another chair, upon which a dentist may sit, to be moved close to the patient in the dental chair.

The back plate 176 of the chair back 22 is covered with a cushion 226 which includes portions 227 which extend outwardly from the side edges 180 above the back plate wings 184 and across the somewhat V-shaped notches 185 defined in the back plate 176 between the top edge 178 and wings 184. As best shown in FIGS. 8 and 12, since the back plate 176 does not underlie the cushion portions 227, these portions are deformable. The deformable portions 227 permit the dentist or technician to move a conventional rolling chair 228 against a recumbent chair back 22 so that the back rest 230 of the rolling chair 228 may deform a deformable portion 227, thereby permitting the dentist to sit on the chair 228 at a conveniently close position relative to the patient. The chair armrest 114, which is not directly connected to the deformable portion 227 of the chair back, is unaffected by the deformation of the chair back.

One of the components on the seat base 44 that is accessible whenever the seat 20 is in the service position is a screw assembly 310 (FIGS. 5, 6A and 6B) that extends through the seat base 44, and is threaded into a rigid accessory arm 312 to fasten the arm to the seat base 44. The accessory arm 312 may extend upwardly from the base 44 to carry a tray or suitable instruments (not shown) on one side of the chair. The accessory arm 312 is pivotally mounted, via screw 313, to the underside of the seat base 44 so that once the screw assembly 310 is retracted, the accessory arm 312 may be swung relative to the seat base to position the tray or instruments on the other side of the chair. The screw assembly 310 is then threaded into the accessory arm 312 through another hole in the base plate 44 to secure the repositioned accessory arm relative to the seat base 44.

Figure 6B:
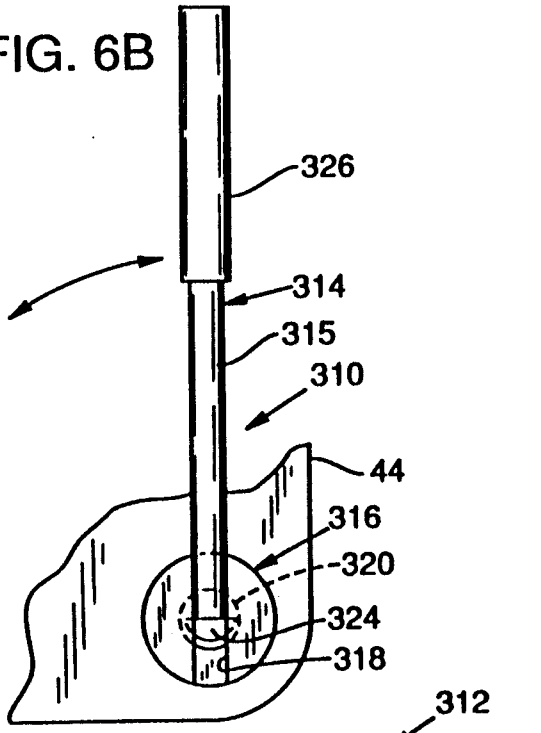
FIG. 6A and 6B depict a convenient screw assembly in stored and operative position, respectively, for securing an accessory component to the chair of the present invention.
Figure 6A:
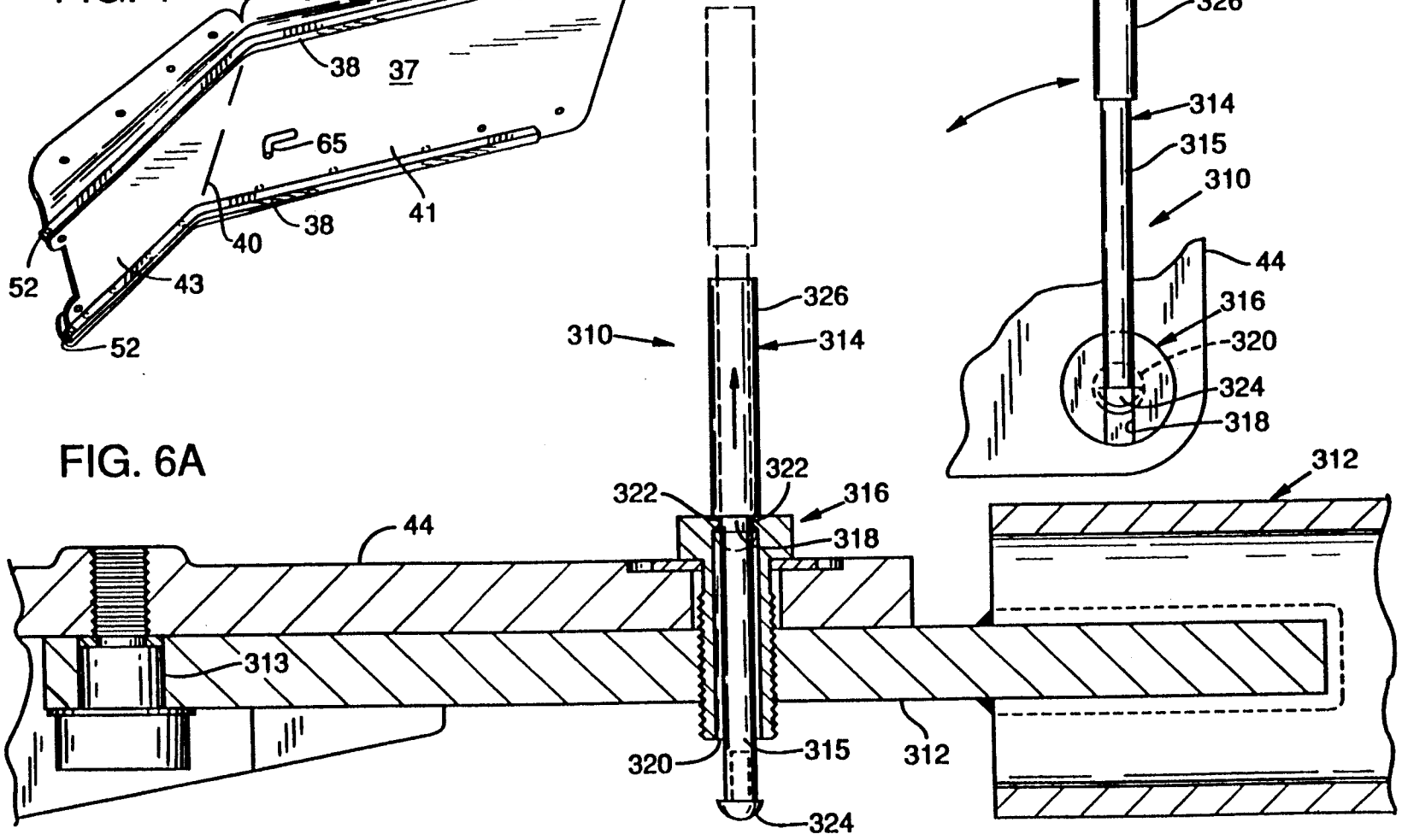
Figure 4:
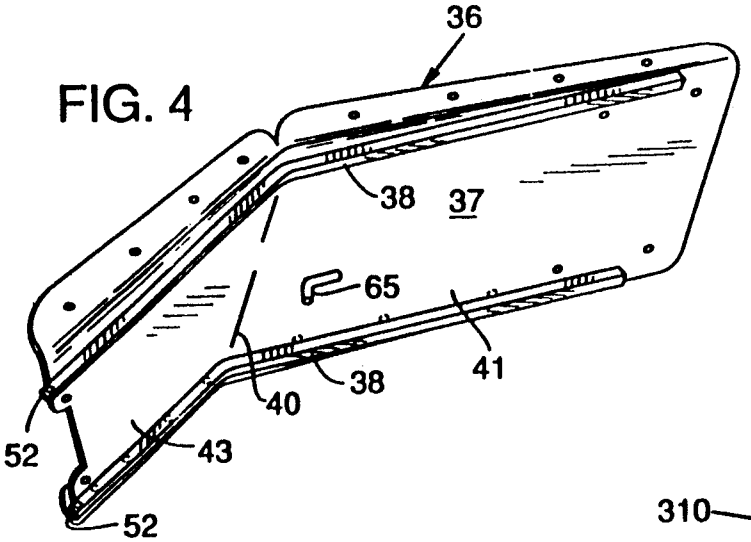
FIG. 4 is a perspective view showing the underside of a structural component of the seat.

The screw assembly 310 of the present invention is configured to include a self-storing handle 314 that permits the screw assembly 310 to be fastened to or removed from the seat base 44 without the use of tools. More particularly, as best shown in FIGS. 6A and 6B, the screw assembly 310 includes a headed screw 316 that has a diametrical slot 318 formed into the headed end thereof. An axial bore 320 extends through the threaded end of the screw 316, but not completely through the headed end of the screw. The bore 320 diameter is larger than the width of the slot 318. Consequently, two opposed shoulders 322 are formed at the terminus of the bore 320 in the head of the screw 316.

The handle 314 comprises a cylindrical rod 315 that fits through the slot 318 and the bore 320 in the headed screw 316. The lower end of the rod 315 has threaded into it a headed fastener 324. The outside diameter of the headed fastener 324 is less than the bore diameter but greater than the width of the slot 318. Consequently, whenever the handle 314 is pulled upwardly, the fastener 324 will move through the bore 320 until it abuts the shoulders 322 in the head of the screw 316.

The upper end of the handle 314 includes a grip 326 that has an outside diameter greater than the width of the slot 318. Accordingly, the fastener 324 and the grip 326 prevent the handle 314 from being movable out of the bore 320 away from the screw 316.

As best shown in the top plan view of FIG. 6B, the screw 316 is rotated by pulling the handle 314 upwardly until the fastener 324 abuts the shoulders 322, and then pivoting the handle to move the lower end of the rod 315 into the slot 318 until the axis of the handle 314 is generally perpendicular to the axis of the screw 316. The handle 314 is then used as a wrench to bear upon the walls of the slot for applying torque for advancing or retracting the screw 316 as desired.

This description now turns to the mechanisms for lifting the chair and for swiveling the chair about a vertical axis.

The chair lift system 45 (FIGS. 2, 5, 13 and 14) includes a base plate 232 that rests upon the floor. A rigid sub-base 234 is mounted to the base plate 232 by four spaced apart bolts 237 (one bolt shown in FIG. 5) that extend vertically through the sub-base 234 and into the base plate 232. The bolts 237 may be removed to permit shipment of the chair with the base plate 232 unattached. Moreover, the bolts 237 may be used to mount the sub-base 234 (hence, the chair) directly to a floor, without the base plate.

The sub-base 234 includes a pair of spaced-apart pivot brackets 236 that protrude upwardly. A reinforcing web 238 extends between the pivot brackets 236. The upper ends of the pivot brackets 236 are pivotally attached, via pins 240, to the forward, lower end of a lift arm 242 that extends between the sub-base 234 and the seat base 44. A pair of link arms 244 are pivotally attached at their forward, lower ends to apertures 241 in the pivot brackets 236. The link arms 244 extend beneath and parallel to the lift arm 242 along each side thereof.

The far end of the lift arm 242 and far ends of the link arms 244 are pivotally mounted in spaced relation to a swivel block 246 that supports the seat base 44. As described below, the seat base 44 is mounted to the swivel block 246 in a manner that permits the base 44 (hence, the chair seat 20 and back 22) to be swiveled about a vertical axis.

Figure 14:
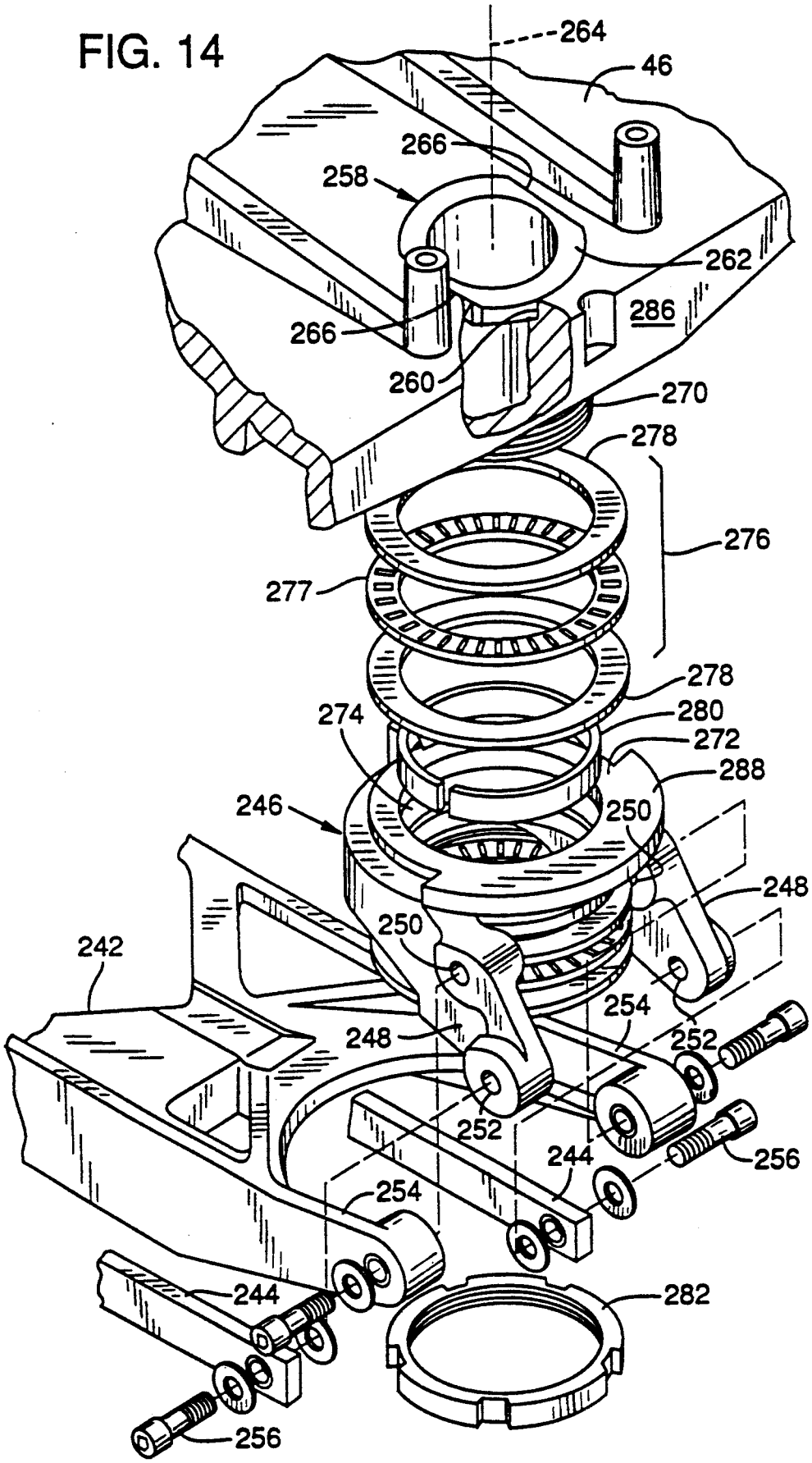
FIG. 14 is an exploded perspective view of the mechanisms for supporting the chair for swiveling motion.

As best seen in FIG. 14, the swivel block 246 is generally cylindrical in shape and has two downwardly depending legs 248. Each leg 248 has a threaded upper aperture 250 and a threaded lower aperture 252 formed therein. The swivel block legs 248 fit between two fingers 254 that extend from the far or upper end of the lift arm 242. Each finger 254 is pivotally attached to the swivel block 246 by a pivot pin 256 that passes through the finger 254 and into an aligned upper aperture 250 in the swivel block. The far or upper ends of the link arms 244 are pivotally attached to the swivel block 246 by pins 256 that pass through the link arms 244 into the lower apertures 252 in the swivel block legs 248.

Figure 13:
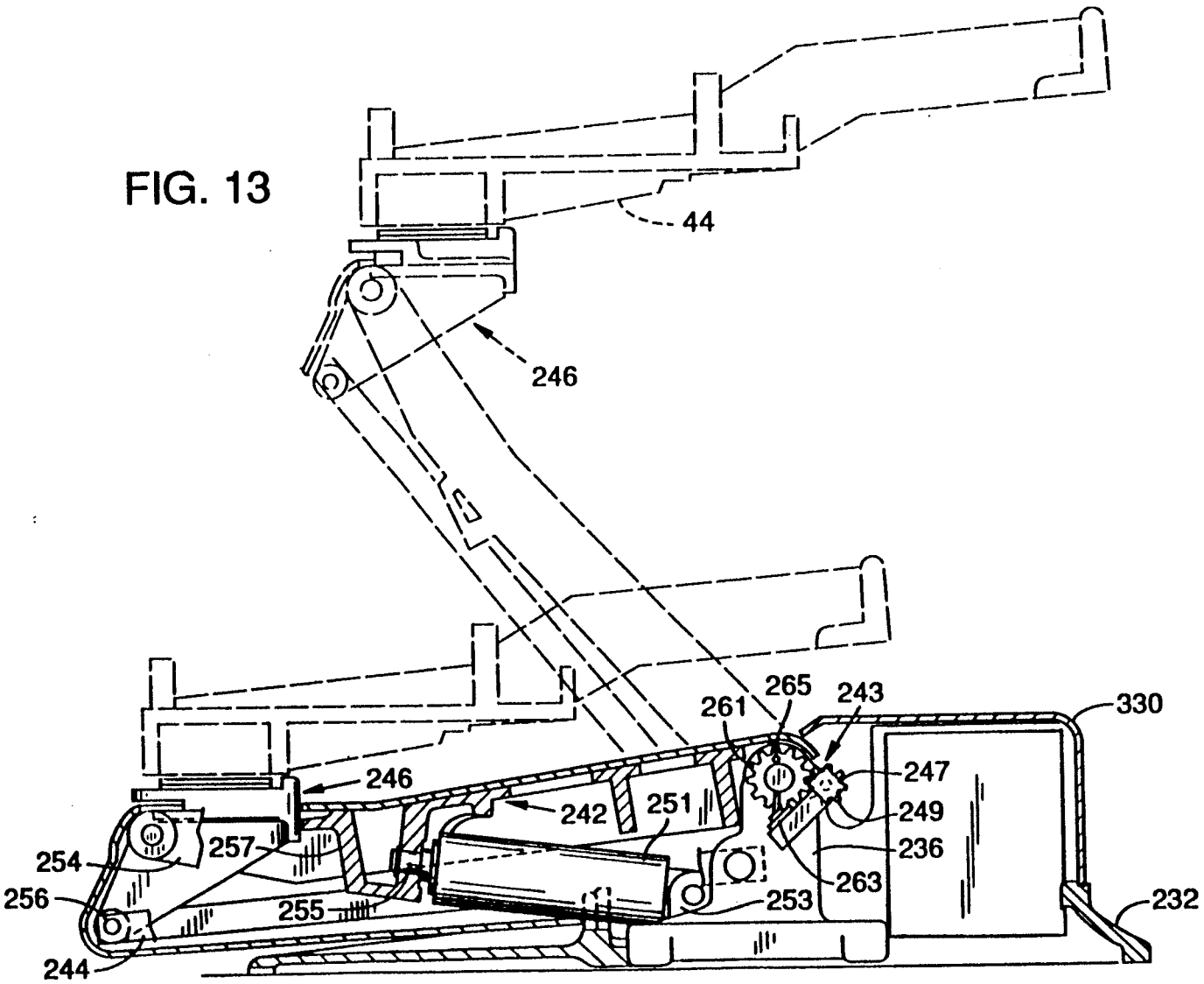
FIG. 13 is a cross-sectional view showing the system for lifting or elevating the chair of the present invention.

A hydraulically driven lift cylinder 251 is employed for lifting the swivel block 246. One end of the lift cylinder is pivotally attached to a bracket 253 that is fastened to the sub-base 234 near the center of the web 238. The end of the piston rod 255 of the lift cylinder 251 is secured within a hole formed in a stub 257 (see FIG. 13) that extends from the underside of the lift arm 242. As the lift cylinder 251 is actuated, the piston rod 255 extends to rotate the lift arm 242 and link arms 244 about their mountings to the pivot brackets 236 so that swivel block 246 (hence the chair seat and back) moves from a lowered position to a raised position (FIG. 13).

The configuration of the pivot brackets 236, pivot bracket apertures 240, 241, lift arm 242, link arms 244, swivel block 246, and swivel block apertures 250, 252 provides a parallel linkage arrangement that is operable for lifting and lowering the swivel block 246 so that the block 246 is not rotated (that is, its vertical motion is translational). Consequently, the seating surface 24 remains at the same slope angle despite lowering and lifting of the chair.

As will be described more fully below, means are provided for controlling the lift cylinder 251 for positioning the chair at any location between the lowered position and the raised position. To this end, the lift system 45 includes a lift-position sensing mechanism 243 for generating lift-position signals representative of the instantaneous angular position of the lift arm 242. The lift-position signals are, therefore, correlated to the elevation of the seat 20. The lift-position signals are supplied to the hereafter described control system 400.

The lift-position sensing mechanism 24 includes a potentiometer 247 that has a geared shaft 249 and is mounted to a pivot bracket 236 on the sub-base 234. The potentiometer 247 is mounted adjacent to one of the pivot pins 240 that provides the pivotal connection of the lower end of the lift arm 242 to the pivot bracket 236. The pivot pin 240 rotates as the lift arm 242 moves and carries a drive gear 261 that meshes with the geared shaft 249 of the potentiometer 247. Consequently, the output or lift-position signals of the potentiometer 247 vary with the position of the lift arm, hence with the elevation of the seat 20.

A lift-limit switch 263 is carried on the bracket 236. The normally closed switch 263 is arranged to be opened by a pin 265 that protrudes from the drive gear 261 in a manner such that the pin 265 contacts the switch arm of, and opens, lift-limit switch 263 as the lift arm 242 reaches the uppermost desired raised position. The lift-limit switch 263 is connected to the control system 400.

Figure 15:
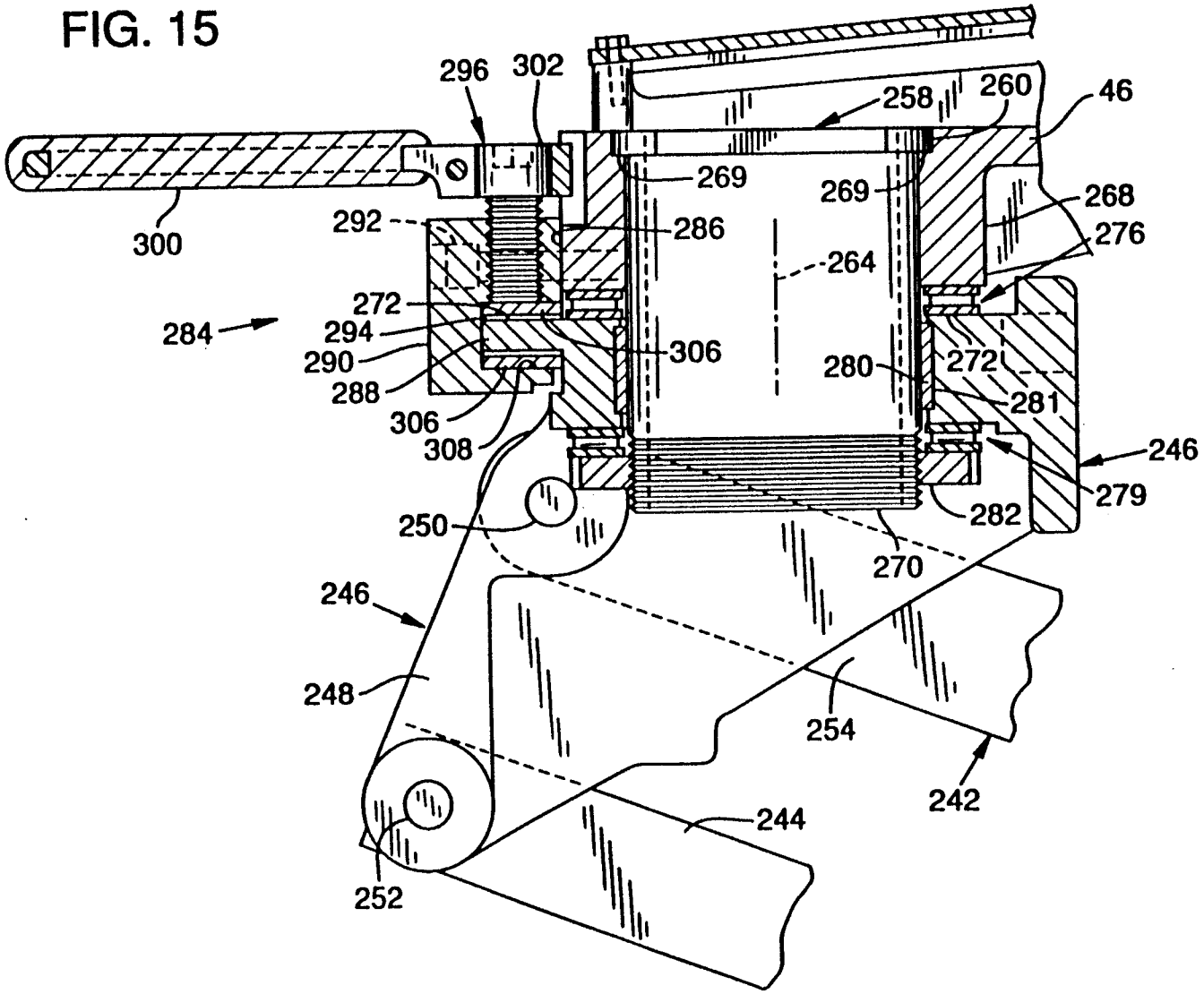
FIG. 15 is a cross-sectional view showing a preferred brake mechanism for controlling the swiveling motion of the chair.

As noted, the seat base 44 is carried by the swivel block 246 and can swivel about a vertical axis 264 (FIG. 14). More particularly, with reference to FIGS. 5, 14 and 15, a rigid swivel tube 258 is mounted to the seat base 44 to extend through the swivel block 246. The swivel tube 258 is rotatable within the swivel block 246 to permit the seat base 44 to swivel about the vertical swivel axis 264. The swivel axis 264 is coaxial with the central axis of the swivel tube 258.

The swivel tube 258 is held in an opening 260 that is formed through the seat base support plate 46 near the rearward end of the plate 46. As viewed from above, the opening 260 is circular except for opposing flat sides 266. A cylindrical collar 268 (FIG. 15) extends downwardly from the support plate 46 beneath the opening 260. The central axis of the collar 268 is coaxial with that of the opening 260, and the inside diameter of the collar 268 is equal to the distance between the flat sides 266 of the opening 260. Consequently, the collar 268 defines a pair of opposing recessed shoulders 269 immediately below the opening 260 in the support plate 46.

The swivel tube 258 has an outside diameter that is slightly smaller than the inside diameter of the collar 268 and includes an externally threaded lower end 270. The upper end of the swivel tube 258 includes an outwardly protruding flange 262 that conforms to the shape of the opening 260. Consequently, the swivel tube 258 fits through the collar 268 with the flange 262 secured within the opening 260 above the collar 268. The flat sides 266 of the opening prevent rotation of the swivel tube 258 relative to the seat base 44.

The swivel block 246 includes a flat annular bearing surface 272 that surrounds the upper end of the central opening 274 of the block 246 (FIG. 14). An annular thrust bearing assembly 276, which includes a thrust bearing 277 that is sandwiched between two rigid races 278, is seated upon the bearing surface 272. The swivel tube 258 extends through the thrust bearing assembly 276 and through the central opening 274 in the block 246.

The lower end of the seat base collar 268 rests upon the bearing assembly 276. Preferably, a thin bearing strip 280 of low-friction material, such as that manufactured by Polymer Corporation, Philadelphia, Pa., under the trademark NYLATRON, is located within an annular groove 281 (FIG. 15) formed in the interior surface of the swivel block 246.

The swivel tube 258 is secured within the swivel block 246 by a spanner nut 282 that is threaded over the externally threaded lower end 270 of the tube 258 with a second thrust bearing assembly 279 disposed between the nut 282 and the underside of the swivel block 246.

As just described, the seat base 44 (hence the chair seat 20 and chair back 22) may be swiveled about the vertical swivel axis 264. The present invention also provides a convenient braking system to permit the dentist to control the swiveling motion of the chair and to lock the chair so that it may not be swiveled. To this end, a brake assembly 284 (FIGS. 8 and 15) is mounted to the rearward side 286 of the seat base 44 for selectively engaging a lip 288 that protrudes radially from the rearward side of the swivel block 246 beyond the rearward side 286 of the seat base 44. The brake assembly 284 includes a rigid caliper block 290 that is attached to the rearward side 286 of the seat base by fasteners 292. The caliper block 290 includes a forward-opening slot 294 into which fits the lip 288 of the swivel block 246. As the seat 20 is swiveled, the caliper block 290 rotates with the seat to move relative to the lip 288 that fits within the slot 294.

A headed screw 296 is threaded along an axis that is generally perpendicular to the upper surface 272 of the lip 288. A handle 300 is attached to the head 302 of the screw 296 such that the handle may be swung to advance or retract the screw 296 in the caliper block 290. Whenever the screw 296 is advanced into the slot 294, the end of the screw bears upon the lip 288 to stop the swiveling motion of the chair. Preferably, the end of the screw 296 that bears upon the lip 288 is covered with a brake pad 306 formed of material such as non-asbestos phenolic laminated, brass wire inserted, commercial grade brake cloth. Moreover, the lower horizontal surface 308 of the caliper block slot 294 includes another brake pad 306 that is positioned beneath the lip 288 and aligned with the screw 296.

Whenever the brake handle 300 is moved to retract the screw 296, the brake is released and the chair may be swiveled. It can be appreciated that the brake assembly 284 of the present invention permits the chair to be swiveled into any selected one of a multitude of positions. Moreover, to stop a swiveling chair, the dentist is able to swing the handle 300 slowly to gradually increase the bearing force applied by the screw 296 against the lip 288 to provide infinitely variable resistance to the swiveling motion of the chair.

Many of the components for moving the chair are enclosed within a housing 330 located at the forward end of the base plate 232 (FIG. 2). The housed components include a pump 332 and hydraulic fluid reservoir 334 for directing hydraulic fluid to and from a pair of conventional solenoid-driven hydraulic valves 336, 338.

Preferably, the pump 332, hydraulic fluid reservoir 334, and hydraulic valves 336, 338 are carried on a removable tray 331. The tray 331 includes a flat bottom and two upwardly projecting opposing end plates 333, 335. The end plates 333, 335 are attached by fasteners 339 (one shown in FIG. 2) to the pivot brackets 236 of the sub-base 234. A printed circuit board 370, which carries control system components as described below, is mounted to one of the end plates 335. The tray 331 facilitates servicing of the chair because the tray may be readily removed from the sub-base to provide access to the components carried on the tray.

Figure 16:
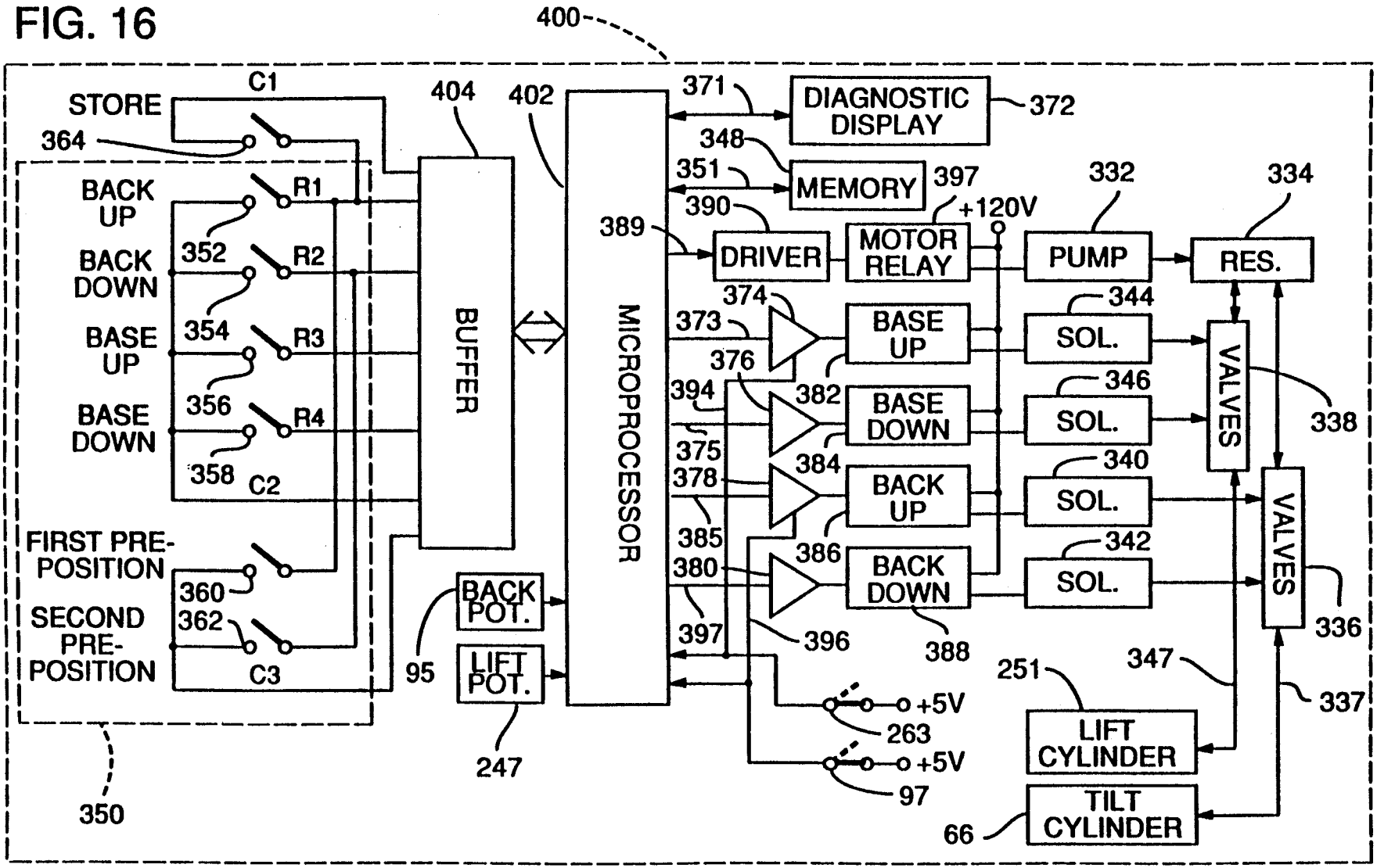
FIG. 16 is a block diagram of the control system for operating the chair.

With reference to the diagram shown in FIG. 16, one valve 336, the "tilt" valve, is operated by a pair of solenoids 340, 342. One solenoid 340 moves the valve 336 into a "back up" position for directing, via line 337, pressurized hydraulic fluid to the tilt cylinder 66 for moving the chair toward the sitting position. The other solenoid 342 moves the valve 336 into a "back down" position for directing, via line 337, hydraulic fluid from the tilt cylinder to the reservoir 334 so that the chair moves toward the recumbent position. Whenever solenoids 340 and 342 are not actuated, the tilt valve 336 assumes a closed position whereby hydraulic fluid is unable to flow to or from the tilt cylinder 66. Accordingly the chair back 22 remains motionless.

The other "lift" valve 338 is operated by a pair of solenoids 344, 346. One solenoid 344 moves the valve 338 into a "base up" position for directing, via line 347, hydraulic fluid to the lift cylinder 251 for moving the lift arm 242 (hence, the seat base 44) toward the raised position. The other solenoid 346 moves the valve 338 into a "base down" position for directing, via line 347, hydraulic fluid from the lift cylinder 251 so that the chair will move toward the lowered position. Whenever solenoids 344 and 346 are not actuated, the lift valve 338 assumes a closed position whereby hydraulic fluid is unable to flow to or from the lift cylinder 251.

The chair control system 400 (FIG. 16) includes a programmable microprocessor 402, such as manufactured by Motorola Corporation and designated MC68705R3P, for overall control of the chair movement and for monitoring the position sensing mechanisms. Preferably, the microprocessor 402 and related circuit components are carried on the PC board 370 that is mounted to the end plate 335 of the removable tray 331.

The chair movement is initiated by switches that are operated by the dentist or technician. Preferably, the switches are an array of foot switches 350 (FIG. 2). The foot switches 350 include a back-up switch 352 and a back-down switch 354. Closing the back-up switch 352 signals the microprocessor 402 to actuate the tilt valve 336 and related mechanisms for moving the chair toward the sitting position. Closing the back-down switch 354 signals the microprocessor 402 to actuate the tilt valve 336 and related mechanisms for moving the chair toward the recumbent position.

The foot switches 350 also include a base-up switch 356 and a base-down switch 358 for signalling the microprocessor to raise and lower the chair. Moreover, the foot switches 350 include two pre-position switches 360, 362, each being operable for initiating movement of the chair seat and back into a preprogrammed position. As will become clear upon reading this description, the pre-position switches 360, 362 permit the dentist to use a single switch to move the chair into any preprogrammed position between and including the sitting and recumbent positions. One such pre-position may be an "exit" position for permitting the patient to exit the chair at the end of a dental procedure.

The normally-open foot switches 352, 354, 356, 358 are connected via respective lines R1, R2, R3 and R4 to the input ports of an octal buffer 404 such as a Texas Instruments SN74LS244N. Moreover, those switches are each connected in series to a line C2 that is also connected to an input port of the buffer 404. The switches are connected to a voltage source so that whenever one of the switches 352, 354, 356, 358 is closed, an associated input signal is applied to the buffer 404 over line C2 and the line R1, R2, R3, or R4 corresponding to the closed switch.

The first pre-position switch 360 and second pre-position switch 362 are respectively connected to the buffer 404 via lines R1 and R2. Moreover, each pre-position switch 360, 362 is connected in series to a line C3 that is also connected to an input port of the buffer 404. The pre-position switches 360, 362 are connected to a voltage source so that whenever one of the switches 360, 362 is closed, a corresponding input signal is applied to the buffer 404 over line C3 and the line R1 or R2 corresponding to the closed switch 360 or 362.

A store switch 364, preferably mounted to the PC board 370 and accessible through an opening in the housing 330, is connected to the buffer 404 via line R1. Moreover, that switch 364 is connected in series with another line C1 that is also connected as an input line to the buffer 404. Accordingly, whenever the store switch 364 is depressed, the buffer 404 receives an associated input signal on line R1 and C1.

The microprocessor 402 is programmed to continuously scan the foot switches 350 and the store switch 364 to determine whether any one of those switches is closed. To this end, the microprocessor 402 is connected to the buffer 404 and continuously scans in row/column fashion the input on lines R1 through R4 and lines C1 through C3.

Any input signal line (R1, R2, R3, or R4) and corresponding column line (C1, C2, or C3) will represent closure of a particular switch. For example, an input signal detected on lines R2 and C3 indicates that the second pre-position switch 362 had been pressed. Similarly, an input signal appearing on lines R2 and C2 indicates that the back-down switch 354 had been pressed. Data correlating the row line R1–R4 and column line C1–C3 combinations with the particular switch being pressed are stored in internal memory within the microprocessor 402.

The microprocessor 402 also receives as input the analog tilt-position signals provided by the potentiometer 95 of the tilt-position sensing mechanism 78. As mentioned, the tilt-position signals generated by the potentiometer 95, which signals are converted to digital form by analog-to-digital converters built into the microprocessor 402, represent the magnitude of the chair back tilt angle A and seat slope angle B at any given time.

The microprocessor 402 is also continuously supplied with the lift-position signals provided by the potentiometer 247 of the lift-position sensing mechanism 243. The lift-position signals represent the elevation of the chair seat 20 between and including the lowered and raised position.

The detected tilt-position signals and lift-position signals are stored in the microprocessor memory as chair position data. In this regard, the microprocessor 402 continuously updates the chair position data in response to changes in the tilt-position and lift-position signals resulting from chair movement.

The microprocessor 402 also receives as input the output signals representing the normally closed tilt-limit switch 97 and lift-limit switch 263. Consequently, whenever the chair is moved into the sitting position, the microprocessor 402 will instantly detect the consequent opening of the tilt-limit switch 97. Similarly, whenever the chair reaches the raised position, the microprocessor 402 will instantly detect the opening of the lift-limit switch 263.

The microprocessor 402 is programmed to continuously compare the input signals received from the foot switches 350 with the signals provided by the potentiometers 95, 247 and the limit switches 97, 263. The microprocessor 402 then initiates movement of the chair in response to a depressed foot switch 350, unless the chair position data or an open limit switch indicate such movement is not possible. For example, if the base-up switch 356 is closed, the microprocessor 402 will check to ensure that the lift-limit switch 263 is closed (that is, the chair is not already at the raised position). If the lift-limit switch 263 is closed, the microprocessor will apply a suitable signal over line 373 to an amplifier 374 for energizing a base-up relay 382. The relay 382 drives the base-up solenoid 344 to switch the lift valve 338 for directing hydraulic fluid to the lift cylinder 251 for lifting the chair.

Simultaneously with actuation of the base-up relay 382 the microprocessor 402 signals over line 389 a motor driver 390 to energize a relay 397 for actuating the hydraulic pump 332. As long as the base-up switch 356 is depressed, the lift cylinder 251 will continue to raise the chair until the lift-limit switch 263 is opened by the pin 265 on the drive gear 261 (FIG. 3) as the chair reaches the raised position.

Whenever the lift-limit switch 263 opens, control voltage applied to the base-up amplifier 374 via line 394 is removed, thereby disabling the relay 382 and associated solenoid 344 so that the lift valve 338 assumes the closed position to halt the flow of hydraulic fluid to the lift cylinder 251.

Whenever the base-down switch 358 is depressed, the microprocessor 402 responds by applying a suitable signal over line 375 to an amplifier 376 for energizing a base-down relay 384. The relay 384 drives the base-down solenoid 346 to move the lift valve 338 into the position for directing hydraulic fluid from the lift cylinder 251. Consequently, the chair is gradually lowered under the influence of gravity.

Whenever the back-up switch 352 is depressed, the microprocessor 402 will check to ensure that the tilt-limit switch 97 is closed (i.e., the chair is not already in the sitting position). If the tilt-limit switch 97 is closed, the microprocessor 402 will apply a suitable signal over line 385 to an amplifier 378 for energizing a back-up relay 386. The relay 386 drives the back-up solenoid 340 to switch the tilt valve 336 for directing hydraulic fluid to the tilt cylinder 66, thereby moving the chair toward the sitting position.

Simultaneously with actuation of the back-up relay 386, the microprocessor 402 signals the motor driver 390 to energize the relay 397 for actuating the hydraulic pump 332. As long as the back-up switch 352 remains depressed, the tilt cylinder 66 will continue to move the chair toward the sitting position until the tilt-limit switch 97 is opened by contact with the slide block 61 as described above. As the tilt-limit switch 97 opens, control voltage applied to the back-up amplifier 378 via line 396 is removed, thereby disabling the relay 386 and associated solenoid 340 so that the tilt valve 336 assumes the closed position to stop hydraulic fluid flow to and from the tilt cylinder 66.

Whenever the back-down foot switch 354 is depressed, the microprocessor 402 responds by applying a suitable signal over line 397 to an amplifier 380 for energizing a back-down relay 388. The back-down relay 388 drives the back-down solenoid 342 to move the tilt valve 336 into the position for directing hydraulic fluid from the tilt cylinder 66. Consequently, the chair is moved toward the recumbent position by the tension springs 72 as described above.

The microprocessor 402 is capable of storing in an associated memory 348 position data representing a particular chair position ("pre-position") selected by the dentist. Thereafter, the microprocessor will respond to a closed pre-position switch 360 or 362 by moving the chair into the stored pre-position. In the preferred embodiment, two such pre-positions may be stored. It is contemplated, however, that additional mechanisms may be employed for storing more than two pre-positions. Preferably, the memory 348 is an electronically erasable, programmable read-only memory (EEPROM), such as manufactured by National Semiconductor and designated NMC9306N.

To store a pre-position, the dentist first operates the switches 352, 354, 356 and 358 to place the chair in the desired pre-position. The dentist then presses the store switch 364 followed by one of the pre-position switches 360 or 362, depending upon which switch 360 or 362 the dentist wishes to use thereafter for moving the chair into the pre-position just defined. The microprocessor 402 detects the depression of the store switch 364 and reads the current position signals provided by the tilt-position sensing mechanism 78 and the lift-position sensing mechanism 243. The position data corresponding to the position signals is stored in the memory 348 at an address corresponding to the pre-position switch 360 or 362 that was depressed immediately after the store switch 364. Thereafter, any time the microprocessor detects actuation of the pre-position switch 360 or 362, it will retrieve from the appropriate location in memory 348 the position data corresponding to the selected pre-position. The microprocessor then compares the selected pre-position data with the instantaneous position data provided by the sensing mechanism 78, 243. The tilt cylinder 66 and/or lift cylinder 251 are actuated as described above to move the chair into the selected pre-position.

The control system 400 of the present invention employs the position sensing mechanisms and limit switches for diagnosing chair malfunctions and for storing data ("error data") representing certain chair component malfunctions. The error data is thereafter available for display to assist a service technician.

The chair malfunctions detected by the control system can be grouped into three categories: (1) foot switch malfunction; (2) chair movement failure; and (3) failure of the chair to reach a selected pre-position.

With respect to malfunctioning foot switches, the microprocessor monitors the period of time during which any particular foot switch 350 remains continuously closed for any reason (for example, a short circuit or mechanical sticking). Upon expiration of a predetermined time limit, such as 45 seconds, the microprocessor turns off whichever actuator mechanism corresponds to the malfunctioning switch. For example, if the back-up switch 352 remains closed for more than 45 seconds, the microprocessor 402 will, after the 45 second interval, remove the signals applied to the motor driver 390 and to back-up relay 386, thereby returning the tilt valve 336 to the closed position. The microprocessor simultaneously generates an error code corresponding to the identified malfunctioning switch (for example, a "1" for a malfunctioning back-up valve switch 352, a "2" for a malfunctioning back-down switch 354, etc.) and stores the error code in memory 348.

Malfunctions pertaining to chair movement failure may result from a defective limit switch, solenoid, or pump motor. To detect a chair movement malfunction, the microprocessor 402 is programmed to monitor the position sensing mechanisms 78, 243 to determine whether the chair is moving in response to any signal for actuating chair movement. For example, in response to a closed back-up switch 352, the microprocessor 402 applies an appropriate signal on lines 389 and 385 to initiate actuation of the hydraulic pump motor 332 and tilt valve 66. The microprocessor 402 then continually monitors the tilt-position signal generated by the potentiometer 95 of the tilt-position sensing mechanism 78. If the tilt-position signals indicate that the chair is not moving (that is, there is no significant difference in three sequentially read tilt-position signals), the microprocessor 402 will generate an error code corresponding to the nature of the failure (for example, a "5" for back-up motion failure, a "6" for back-down motion failure, etc.). These error codes are then stored in memory 348.

An improperly connected potentiometer 95, 247 may cause the chair to fail to reach a selected pre-position. This failure is detected when, after a period of approximately 45 seconds, the position data represented by the selected pre-position do not correspond with the tilt-position and lift-position signals provided by the potentiometers 95, 247. Consequently, the microprocessor will halt chair movement and store in memory 348 an error code representing this failure.

The just-described error data is available for display to assist in servicing the chair. Preferably, the present invention includes a portable diagnostic display device 372 that is connectable with the chair control system 400 to provide a visual display of any error data stored in the memory 348 of the control system 400.

Figure 17:
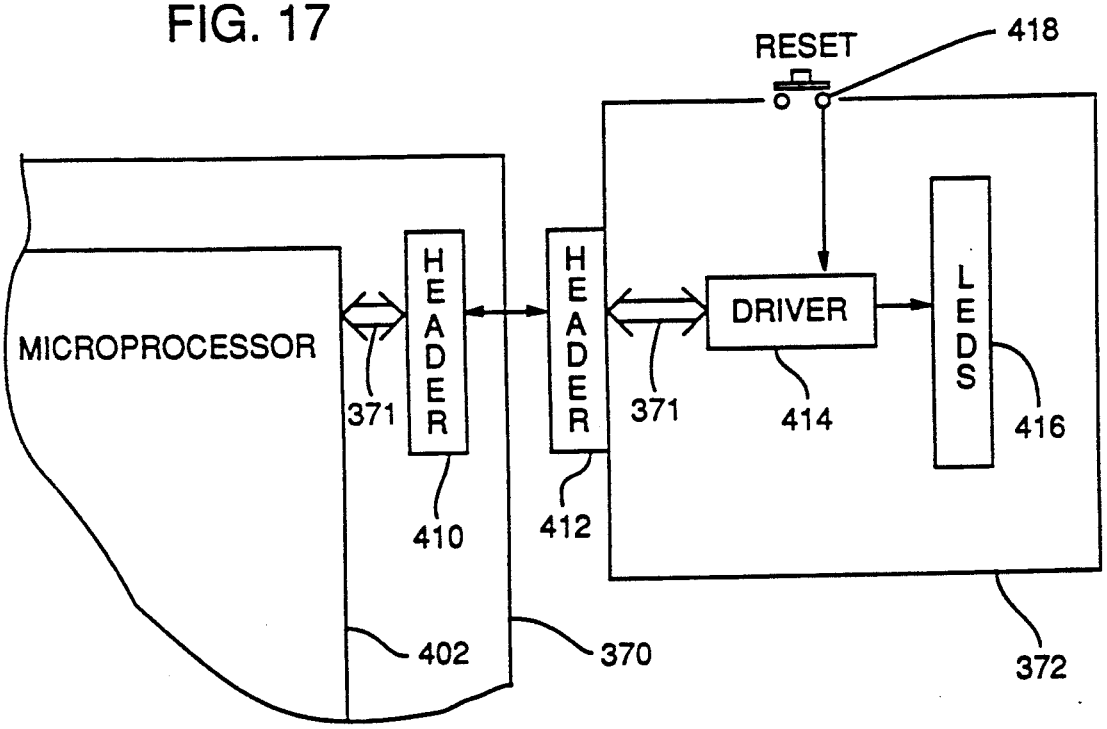
FIG. 17 a block diagram of a diagnostic device for providing indicia of malfunctioning chair components detected by the control system.

With reference to FIGS. 16 and 17, the display device 372 is a hand-held article and includes an eight-position header 412 that is connected to a corresponding header 410 mounted on the control system PC board 370. The headers 410, 412 provide interconnection between the microprocessor 402 and a light-emitting diode (LED) driver 414 via line 371.

The microprocessor 402 continuously applies on line 371 a serial bit stream of error data stored in memory 348. Consequently, as soon as the display device 372 is plugged into the PC board via the connected headers 410, 412, the LED driver 414 receives as input all of the error data. The driver 414 then drives a bank of LEDs 416 to display the received error data for viewing by the service technician.

A reset switch 418 is provided for signaling to the microprocessor 402 to clear all error codes from its memory 348. The reset switch 418 is depressed after the chair is serviced so that the technician can operate the chair and thereafter use the diagnostic display device to determine whether any new error codes are generated.

While the present invention has been described in accordance with preferred embodiments, it is to be understood that certain substitutions and alterations may be made thereto without departing from the spirit and scope of the appended claims.

We claim:

1. Apparatus for controlling the position of a dental chair that has a seat and a back that is movable between an upright position and a recumbent position, comprising:

an actuator mounted to the chair and having an extendable and retractable actuator member;

a link connected between the actuator member and the back so that extension and retraction of the actuator member moves the back;

a first sensor component carried by the actuator member to move therewith;

a guide member mounted to the chair for constraining movement of the first sensor component to be substantially linear; and sensing means mounted to the chair for sensing the movement of the first sensor component and for providing signals representative of the position of the back between the upright position and the recumbent position.

2. The apparatus of claim 1 wherein the sensor is a potentiometer.

3. The apparatus of claim 1 further comprising a limit switch mounted to the chair for providing a signal whenever the back moves into the upright position.

4. An apparatus for controlling the position of a dental chair that has a seat and a back that is movable between an upright position and a recumbent position, comprising:

an actuator mounted to the chair and having an extendable and retractable actuator member;

a link connected between the actuator member and the back so that extension and retraction of the actuator member moves the back;

a slide member connected to the actuator member for movement therewith;

a rotatable member rotatably mounted to the chair adjacent to the slide member and shaped so that the moving slide member contacts and rotates the rotatable member; and a sensor connected to the rotatable member to generate position signals that vary in response to the rotation of the rotatable member.

5. The apparatus of claim 4 wherein the rotatable member comprises an elongated helical bar, the slide member being configured and arranged to engage a surface of the bar and move in a direction generally parallel to the length of the bar.

6. The apparatus of claim 4 wherein the movement of the slide member is substantially constrained to translational movement by a guide member that is mounted to the chair.

7. The apparatus of claim 4 wherein the link is connected to the actuator member by a connecting rod and wherein the slide member is carried on the connecting rod.

8. The apparatus of claim 4 wherein the rotatable member comprises an elongated helical-shaped bar mounted near the slide member, the slide member including a yoke for engaging opposing sides of the bar thereby to rotate the rotatable member when the slide member moves.

9. A system for controlling a movable chair having a back and seat, wherein the chair is movable into a plurality of positions, the system comprising:

actuation means controllable for moving the chair;

sensing means for sensing the position of the chair and for generating position signals representative of the chair position, the sensing means including tilt-position means for generating position signals representative of the chair back position, the tilt-position means including a slide member connected to the back for movement therewith, and a rotatable member rotatably mounted to the chair adjacent to the slide member, the rotatable member having an inclined surface that contacts the slide member so that the rotatable member is rotated by movement of the slide member, the position signals changing in response to the rotation of the rotatable member; and processing means for monitoring position signals generated by the tilt-position means and for controlling the actuation means for moving the chair.

10. The system of claim 9 wherein the sensing means includes lift-position means for generating lift position signals representative of the elevation of the chair seat.

11. A control apparatus connectable to an actuator that extends and retracts to move the back of a dental chair, comprising:

a slide member;

a connecting rod for connecting the slide member and the actuator so that the slide member moves in a first direction with the actuator;

an elongated bar having helical sides and mounted for rotation adjacent to the slide member so that the long axis of the bar is substantially parallel with the first direction;

a yoke attached to the slide member to engage the sides of the bar so that movement of the slide member in a first direction rotates the bar; and a sensor connected to the bar for sensing the rotation of the bar thereby to sense motion of the back.

12. The apparatus of claim 11 further comprising elongated guide member mounted near the bar to extend substantially parallel thereto, the slide member being sized to fit between the bar and guide member, the motion of the slide member being constrained in the first direction by the bar and guide member.

13. The apparatus of claim 11 including a spring having one end connected to the connecting rod and another end attached to the chair, the spring being operable for pulling the connecting rod in a direction opposite that of the first direction.

14. A method for controlling the position of a dental chair that has a seat and a back that is movable between an upright position and a recumbent position, comprising the steps of:

linking to the back a sliding member that moves when the back moves;

mounting adjacent to the back a helical member;

connecting the sliding member and the helical member so that linear movement of the sliding member contacts and rotates the helical member; and generating in response to the rotation of the helical member signals that are read by a position sensing mechanism as indicative of the movement of the back.

15. The method of claim 14 further including a step of guiding the sliding member to move in translational motion.

* * * * *